US010045572B2

(12) United States Patent
Bratcher

(10) Patent No.: US 10,045,572 B2
(45) Date of Patent: Aug. 14, 2018

(54) EXERCISE GARMENT WITH DISTRIBUTED WEIGHT AND METHOD

(76) Inventor: Thomas Paul Bratcher, Scottsdale, AZ (US)

( * ) Notice: Subject to any disclaimer, the term of this patent is extended or adjusted under 35 U.S.C. 154(b) by 2111 days.

(21) Appl. No.: 13/225,163

(22) Filed: Sep. 2, 2011

(65) Prior Publication Data

US 2013/0055484 A1 Mar. 7, 2013

(51) Int. Cl.
*A41D 13/00* (2006.01)

(52) U.S. Cl.
CPC ..... *A41D 13/0015* (2013.01)

(58) Field of Classification Search
CPC ..... A41D 13/0015; A41D 13/0058; A41D 13/0012; A41D 2600/10
USPC ..... 2/69; 482/105
See application file for complete search history.

(56) References Cited

U.S. PATENT DOCUMENTS 3,759,510 A 9/1973 Jackson, Jr.
4,268,917 A 5/1981 Massey
4,384,369 A 5/1983 Prince
4,910,802 A * 3/1990 Malloy ..... 2/69
4,911,433 A * 3/1990 Walker et al. ..... 482/105
4,953,856 A 9/1990 Fox, III
5,010,596 A 4/1991 Brown
5,033,117 A 7/1991 Fairweather
5,048,125 A 9/1991 Libertini
5,144,694 A 9/1992 Conrad Da oud
5,553,322 A 9/1996 Cebo-Johnson
5,659,898 A * 8/1997 Bell, Jr. ..... 2/69
5,708,976 A 1/1998 Dicker
5,826,273 A * 10/1998 Eckes ..... 2/69
5,893,223 A * 4/1999 Glass ..... 36/132
5,937,441 A 8/1999 Raines
5,978,964 A 11/1999 Gaston
6,438,755 B1 * 8/2002 MacDonald et al. ..... 2/69
6,692,413 B1 * 2/2004 Greenberg et al. ..... 482/105
7,376,979 B2 5/2008 Nilsen
7,708,673 B2 5/2010 Gibson-Horn
8,156,572 B2 * 4/2012 Whaley ..... 2/69
8,245,322 B1 * 8/2012 Bouza ..... 2/102
8,832,863 B2 * 9/2014 Yang ..... 2/69
8,944,974 B2 * 2/2015 Foster ..... 482/124
2003/0092544 A1 * 5/2003 Reed ..... 482/105
2004/0221355 A1 11/2004 Garcia
2006/0046913 A1 * 3/2006 Squittieri ..... 482/124
2006/0135326 A1 * 6/2006 Virji et al. ..... 482/105
2006/0200890 A1 * 9/2006 Prat Gonzalez ..... 2/69
2007/0256206 A1 11/2007 Nilsen
2009/0139005 A1 6/2009 Whaley
2010/0319099 A1 12/2010 Washington, Sr.
2011/0167533 A1 * 7/2011 Stewart ..... 2/102
2011/0274903 A1 * 11/2011 Stuart et al. ..... 428/219
2013/0000021 A1 * 1/2013 Dolcetti ..... 2/455
2013/0017933 A1 1/2013 Foster
(Continued)

OTHER PUBLICATIONS

PCT International Preliminary Report on Patentability and Written Opinion for PCT US2012/052593; dated Mar. 13, 2014.
(Continued)

*Primary Examiner* — Alissa L Hoey
(74) *Attorney, Agent, or Firm* — Kevin B. Jackson

(57) ABSTRACT

In one embodiment, a weighted exercise garment includes multiple parts. The garment is weighted with weights being distributed about the garment in a predetermined manner.

28 Claims, 23 Drawing Sheets

(56) References Cited

U.S. PATENT DOCUMENTS

| | | | | |
|---|---|---|---|---|
| 2013/0085040 | A1* | 4/2013 | Bowers | 482/8 |
| 2013/0298301 | A1* | 11/2013 | Petrakis et al. | 2/69 |
| 2014/0005010 | A1* | 1/2014 | Kaminsky | 482/105 |
| 2014/0200118 | A1* | 7/2014 | Lathen | 482/105 |
| 2014/0302970 | A1* | 10/2014 | Sinclair | 482/105 |

OTHER PUBLICATIONS

Jennifer L. Durkin et al., Analysis of Body Segment Parameter Differences Between Four Human Populations and the Estimation Errors of Four Popular Mathematical Models, Journal of Biomechanical Engineering, Transactions of the ASME, Aug. 2003, pp. 515-522, vol. 125, U.S.A.

Anthropometry and Mass Distribution for Human Analogues, vol. I: Military Male Aviators, Mar. 1988, Harry G. Armstrong Aerospace Medical Research Laboratory Wright-Patterson Air Force Base, Ohio 45433-6573 AAMRL-TR-88-010.

Paolo De Leva, Adjustments to Zatsiorsky-Seluyanov's Segment Inertia Parameters, Journal of Biomechanics, vol. 29, No. 9, 1996, pp. 1223-1230, Elsevier, Great Britain.

* cited by examiner

| A | B | C Kp | D Kpr | E Kr | F | | G Kr cfg | | H lbs |
|---|---|---|---|---|---|---|---|---|---|
| Part 1 Central Body Portion (22) | 1a Thorax Region (24) | 0.37 | 0.60 | 0.222 | X | | 0.222 | | 4.4 |
| | 2a Abdominal Region (26) | | 0.40 | 0.148 | X | | 0.148 | | 3.0 |
| Part 2 Lower Extremity Portion (28) | 3a Pelvic Region (32) | 0.45 | 0.30 | 0.135 | X | | 0.135 | | 2.7 |
| | 4a Thigh Regions (34) | | 0.45 | 0.203 | X | | 0.203 | | 4.1 |
| | 5a Calf Regions (36) | | 0.19 | 0.086 | X | | 0.086 | | 1.7 |
| | 6a Foot Regions (41) | | 0.06 | 0.027 | X | | 0.027 | | 0.5 |
| Part 3 Upper Extremity Portion (44) | 7a Upper Arm Regions (46) | 0.10 | 0.55 | 0.055 | X | | 0.055 | | 1.1 |
| | 8a Forearm Regions (48) | | 0.33 | 0.033 | X | | 0.033 | | 0.7 |
| | 9a Hand Regions (51) | | 0.12 | 0.012 | X | | 0.012 | | 0.2 |
| Part 4 Head Portion (52) | 10a Neck Region (53) | 0.08 | 0.26 | 0.021 | X | | 0.021 | | 0.4 |
| | 11a Head Region (56) | | 0.74 | 0.059 | X | | 0.059 | | 1.2 |
| | | | | | | Mcv | 1.00 | | |
| | | | | | | GW | 20 | LW | 20 |

*FIG. 4*

| A | B | C Kp | D Kpr | E Kr | F | | G Kr cfg | | H lbs |
|---|---|---|---|---|---|---|---|---|---|
| Part 1 Central Body Portion (22) | 1a Thorax Region (24)<br>2a Abdominal Region (26) | 0.37 | 0.60<br>0.40 | 0.222<br>0.148 | X<br>X | | 0.222<br>0.148 | | 6.0<br>4.0 |
| Part 2 Lower Extremity Portion (28) | 3a Pelvic Region (32)<br>4a Thigh Regions (34)<br>5a Calf Regions (36)<br>6a Foot Regions (41) | 0.45 | 0.30<br>0.45<br>0.19<br>0.06 | 0.135<br>0.203<br>0.086<br>0.027 | | | | | |
| Part 3 Upper Extremity Portion (44) | 7a Upper Arm Regions (46)<br>8a Forearm Regions (48)<br>9a Hand Regions (51) | 0.10 | 0.55<br>0.33<br>0.12 | 0.055<br>0.033<br>0.012 | | | | | |
| Part 4 Head Portion (52) | 10a Neck Region (53)<br>11a Head Region (56) | 0.08 | 0.26<br>0.74 | 0.021<br>0.059 | | | | | |
| | | | | | | Mcv<br>GW | 0.37<br>27.03 | LW | 10 |

FIG. 10

| A | B | C Kp | D Kpr | E Kr | F | | G Kr cfg | | H lbs |
|---|---|---|---|---|---|---|---|---|---|
| Part 1 Central Body Portion (22) | 1a Thorax Region (24)<br>2a Abdominal Region (26) | 0.37 | 0.60<br>0.40 | 0.222<br>0.148 | X<br>X | | 0.222<br>0.148 | | 4.7<br>3.1 |
| Part 2 Lower Extremity Portion (28) | 3a Pelvic Region (32)<br>4a Thigh Regions (34)<br>5a Calf Regions (36)<br>6a Foot Regions (41) | 0.45 | 0.30<br>0.45<br>0.19<br>0.06 | 0.135<br>0.203<br>0.086<br>0.027 | X<br>X | | 0.135<br>0.203 | | 2.9<br>4.3 |
| Part 3 Upper Extremity Portion (44) | 7a Upper Arm Regions (46)<br>8a Forearm Regions (48)<br>9a Hand Regions (51) | 0.10 | 0.55<br>0.33<br>0.12 | 0.055<br>0.033<br>0.012 | | | | | |
| Part 4 Head Portion (52) | 10a Neck Region (53)<br>11a Head Region (56) | 0.08 | 0.26<br>0.74 | 0.021<br>0.059 | | | | | |
| | | | | | | Mcv<br>GW | 0.71<br>21.2 | LW | 15 |

FIG. 13

| A | B | C Kp | D Kpr | E Kr | F | | G Kr cfg | | H lbs |
|---|---|---|---|---|---|---|---|---|---|
| Part 1 Central Body Portion (22) | 1a Thorax Region (24)<br>2a Abdominal Region (26) | 0.37 | 0.60<br>0.40 | 0.222<br>0.148 | X<br>X | | 0.222<br>0.148 | | 4.2<br>2.8 |
| Part 2 Lower Extremity Portion (28) | 3a Pelvic Region (32)<br>4a Thigh Regions (34)<br>5a Calf Regions (36)<br>6a Foot Regions (41) | 0.45 | 0.30<br>0.45<br>0.19<br>0.06 | 0.135<br>0.203<br>0.086<br>0.027 | X<br>X<br>X | | 0.135<br>0.203<br>0.086 | | 2.6<br>3.8<br>1.6 |
| Part 3 Upper Extremity Portion (44) | 7a Upper Arm Regions (46)<br>8a Forearm Regions (48)<br>9a Hand Regions (51) | 0.10 | 0.55<br>0.33<br>0.12 | 0.055<br>0.033<br>0.012 | | | | | |
| Part 4 Head Portion (52) | 10a Neck Region (53)<br>11a Head Region (56) | 0.08 | 0.26<br>0.74 | 0.021<br>0.059 | | | | | |
| | | | | | | Mcv<br>GW | 0.79<br>18.92 | LW | 15 |

FIG. 16

| A | B | C Kp | D Kpr | E Kr | F | | G Kr cfg | | H lbs |
|---|---|---|---|---|---|---|---|---|---|
| Part 1 Central Body Portion (22) | 1a Thorax Region (24) | 0.37 | 0.60 | 0.222 | X | | 0.222 | | 5.4 |
| | 2a Abdominal Region (26) | | 0.40 | 0.148 | X | | 0.148 | | 3.6 |
| Part 2 Lower Extremity Portion (28) | 3a Pelvic Region (32) | 0.45 | 0.30 | 0.135 | X | | 0.135 | | 3.3 |
| | 4a Thigh Regions (34) | | 0.45 | 0.203 | X | | 0.203 | | 4.9 |
| | 5a Calf Regions (36) | | 0.19 | 0.086 | X | | 0.086 | | 2.1 |
| | 6a Foot Regions (41) | | 0.06 | 0.027 | X | | 0.027 | | 0.7 |
| Part 3 Upper Extremity Portion (44) | 7a Upper Arm Regions (46) | 0.10 | 0.55 | 0.055 | | | | | |
| | 8a Forearm Regions (48) | | 0.33 | 0.033 | | | | | |
| | 9a Hand Regions (51) | | 0.12 | 0.012 | | | | | |
| Part 4 Head Portion (52) | 10a Neck Region (53) | 0.08 | 0.26 | 0.021 | | | | | |
| | 11a Head Region (56) | | 0.74 | 0.059 | | | | | |
| | | | | | | Mcv | 0.82 | | |
| | | | | | | GW | 24.39 | LW | 20 |

FIG. 19

| A | B | C<br>Kp | D<br>Kpr | E<br>Kr | F | | G<br>Kr cfg | | H<br>lbs |
|---|---|---|---|---|---|---|---|---|---|
| Part 1 Central Body Portion (22) | 1a Thorax Region (24)<br>2a Abdominal Region (26) | 0.37 | 0.60<br>0.40 | 0.222<br>0.148 | X<br>X | | 0.222<br>0.148 | | 5.8<br>3.9 |
| Part 2 Lower Extremity Portion (28) | 3a Pelvic Region (32)<br>4a Thigh Regions (34)<br>5a Calf Regions (36)<br>6a Foot Regions (41) | 0.45 | 0.30<br>0.45<br>0.19<br>0.06 | 0.135<br>0.203<br>0.086<br>0.027 | X<br>X | | 0.135<br>0.203 | | 3.5<br>5.3 |
| Part 3 Upper Extremity Portion (44) | 7a Upper Arm Regions (46)<br>8a Forearm Regions (48)<br>9a Hand Regions (51) | 0.10 | 0.55<br>0.33<br>0.12 | 0.055<br>0.033<br>0.012 | X | | 0.055 | | 1.4 |
| Part 4 Head Portion (52) | 10a Neck Region (53)<br>11a Head Region (56) | 0.08 | 0.26<br>0.74 | 0.021<br>0.059 | | | | | |
| | | | | | | Mcv<br>GW | 0.76<br>26.23 | LW | 20 |

FIG. 22

| A | B | C Kp | D Kpr | E Kr | F | | G Kr cfg | | H lbs |
|---|---|---|---|---|---|---|---|---|---|
| Part 1 Central Body Portion (22) | 1a Thorax Region (24)<br>2a Abdominal Region (26) | 0.37 | 0.60<br>0.40 | 0.222<br>0.148 | X<br>X | | 0.222<br>0.148 | | 7.0<br>4.7 |
| Part 2 Lower Extremity Portion (28) | 3a Pelvic Region (32)<br>4a Thigh Regions (34)<br>5a Calf Regions (36)<br>6a Foot Regions (41) | 0.45 | 0.30<br>0.45<br>0.19<br>0.06 | 0.135<br>0.203<br>0.086<br>0.027 | X<br>X | | 0.135<br>0.203 | | 4.2<br>6.4 |
| Part 3 Upper Extremity Portion (44) | 7a Upper Arm Regions (46)<br>8a Forearm Regions (48)<br>9a Hand Regions (51) | 0.10 | 0.55<br>0.33<br>0.12 | 0.055<br>0.033<br>0.012 | X<br>X | | 0.055<br>0.033 | | 1.7<br>1.0 |
| Part 4 Head Portion (52) | 10a Neck Region (53)<br>11a Head Region (56) | 0.08 | 0.26<br>0.74 | 0.021<br>0.059 | | | | | |
| | | | | | | Mcv<br>GW | 0.80<br>31.43 | LW | 25 |

FIG. 25

| A | B | C Kp | D Kpr | E Kr | F | | G Kr cfg | | H lbs |
|---|---|---|---|---|---|---|---|---|---|
| Part 1 Central Body Portion (22) | 1a Thorax Region (24) | 0.37 | 0.60 | 0.222 | X | | 0.222 | | 7.6 |
| | 2a Abdominal Region (26) | | 0.40 | 0.148 | X | | 0.148 | | 5.0 |
| Part 2 Lower Extremity Portion (28) | 3a Pelvic Region (32) | 0.45 | 0.30 | 0.135 | X | | 0.135 | | 4.6 |
| | 4a Thigh Regions (34) | | 0.45 | 0.203 | X | | 0.203 | | 6.9 |
| | 5a Calf Regions (36) | | 0.19 | 0.086 | X | | 0.086 | | 2.9 |
| | 6a Foot Regions (41) | | 0.06 | 0.027 | | | | | |
| Part 3 Upper Extremity Portion (44) | 7a Upper Arm Regions (46) | 0.10 | 0.55 | 0.055 | X | | 0.055 | | 1.9 |
| | 8a Forearm Regions (48) | | 0.33 | 0.033 | X | | 0.033 | | 1.1 |
| | 9a Hand Regions (51) | | 0.12 | 0.012 | | | | | |
| Part 4 Head Portion (52) | 10a Neck Region (53) | 0.08 | 0.26 | 0.021 | | | | | |
| | 11a Head Region (56) | | 0.74 | 0.059 | | | | | |
| | | | | | | Mcv | 0.88 | | |
| | | | | | | GW | 34.05 | LW | 30 |

*FIG. 28*

| A | B | C Kp | D Kpr | E Kr | F | | G Kr cfg | | H lbs |
|---|---|---|---|---|---|---|---|---|---|
| Part 1 Central Body Portion (22) | 1a Thorax Region (24) | 0.37 | 0.60 | 0.222 | X | | 0.222 | | 8.6 |
| | 2a Abdominal Region (26) | | 0.40 | 0.148 | X | | 0.148 | | 5.7 |
| Part 2 Lower Extremity Portion (28) | 3a Pelvic Region (32) | 0.45 | 0.30 | 0.135 | X | | 0.135 | | 5.2 |
| | 4a Thigh Regions (34) | | 0.45 | 0.203 | X | | 0.203 | | 7.8 |
| | 5a Calf Regions (36) | | 0.19 | 0.086 | X | | 0.086 | | 3.3 |
| | 6a Foot Regions (41) | | 0.06 | 0.027 | X | | 0.027 | | 1.0 |
| Part 3 Upper Extremity Portion (44) | 7a Upper Arm Regions (46) | 0.10 | 0.55 | 0.055 | X | | 0.055 | | 2.1 |
| | 8a Forearm Regions (48) | | 0.33 | 0.033 | X | | 0.033 | | 1.3 |
| | 9a Hand Regions (51) | | 0.12 | 0.012 | | | | | |
| Part 4 Head Portion (52) | 10a Neck Region (53) | 0.08 | 0.26 | 0.021 | | | | | |
| | 11a Head Region (56) | | 0.74 | 0.059 | | | | | |
| | | | | | | Mcv | 0.91 | | |
| | | | | | | GW | 38.55 | LW | 35 |

*FIG. 31*

| A | B | C Kp | D Kpr | E Kr | F | | G Kr cfg | | H lbs |
|---|---|---|---|---|---|---|---|---|---|
| Part 1 Central Body Portion (22) | 1a Thorax Region (24) | 0.37 | 0.60 | 0.222 | X | | 0.222 | | 8.4 |
| | 2a Abdominal Region (26) | | 0.40 | 0.148 | X | | 0.148 | | 5.6 |
| Part 2 Lower Extremity Portion (28) | 3a Pelvic Region (32) | 0.45 | 0.30 | 0.135 | X | | 0.135 | | 5.1 |
| | 4a Thigh Regions (34) | | 0.45 | 0.203 | X | | 0.203 | | 7.7 |
| | 5a Calf Regions (36) | | 0.19 | 0.086 | X | | 0.086 | | 3.3 |
| | 6a Foot Regions (41) | | 0.06 | 0.027 | X | | 0.027 | | 1.0 |
| Part 3 Upper Extremity Portion (44) | 7a Upper Arm Regions (46) | 0.10 | 0.55 | 0.055 | X | | 0.055 | | 2.1 |
| | 8a Forearm Regions (48) | | 0.33 | 0.033 | X | | 0.033 | | 1.3 |
| | 9a Hand Regions (51) | | 0.12 | 0.012 | X | | 0.012 | | 0.5 |
| Part 4 Head Portion (52) | 10a Neck Region (53) | 0.08 | 0.26 | 0.021 | | | | | |
| | 11a Head Region (56) | | 0.74 | 0.059 | | | | | |
| | | | | | | Mcv | 0.92 | | |
| | | | | | | GW | 38.04 | LW | 35 |

FIG. 34

EXERCISE GARMENT WITH DISTRIBUTED WEIGHT AND METHOD

BACKGROUND OF THE INVENTION

This document relates generally to exercise apparel and more specifically to garments that are weighted and methods therefore.

It is well established that weight training or resistance training advances the performance of the body's muscle system, strength, and stamina. Various forms of wearable weighted devices are known for such training activities. However, such devices are not configured for effective muscle system performance enhancement and can even lead to injury based on improper configuration or use.

Accordingly, structures and methods that provide improved personal training, fitness, health, and well-being are needed.

BRIEF DESCRIPTION OF THE DRAWINGS

FIG. 4 is a table illustrating a mass distribution model in accordance with an embodiment of the present invention;

FIG. 10 is a table illustrating a mass distribution model in accordance with the present invention for forming the second embodiment;

FIG. 13 is a table illustrating a mass distribution model in accordance with the present invention for forming the third embodiment;

FIG. 16 is a table illustrating a mass distribution model in accordance with the present invention for forming the fourth embodiment;

FIG. 19 is a table illustrating a mass distribution model in accordance with the present invention for forming the fifth embodiment;

FIG. 22 is a table illustrating a mass distribution model in accordance with the present invention for forming the sixth embodiment;

FIG. 25 is a table illustrating a mass distribution model in accordance with the present invention for forming the seventh embodiment;

FIG. 28 is a table illustrating a mass distribution model in accordance with the present invention for forming the eighth embodiment;

FIG. 31 is a table illustrating a mass distribution model in accordance with the present invention for forming the ninth embodiment;

FIG. 34 is a table illustrating a mass distribution model in accordance with the present invention for forming the tenth embodiment.

For simplicity and clarity of the illustration, elements in the figures are not necessarily drawn to exact scale, are only schematic and are non-limiting, and the same reference numbers in different figures denote the same elements, unless stated otherwise. Additionally, descriptions and details of well-known steps and elements are omitted for simplicity of the description. The terms "first", "second", "third", and the like in the Claims or/and in the Detailed Description of the Drawings are used for distinguishing between similar elements and not necessarily for describing a sequence temporally, spatially, in ranking, or in any other manner.

DETAILED DESCRIPTION OF THE DRAWINGS

In general, the present description pertains to a weighted garment that comprises a material that can be configured to substantially conform to at least a portion of the body of an intended wearer when it is placed on the wearer. The garment also includes a plurality of weights that sum to a total weight that is distributed about the material in accordance with a predetermined body mass distribution of the intended wearer. The present description also pertains to a method of forming a weighted garment that comprises the steps of providing a predetermined weight distribution that is a function of a body mass distribution of an intended wearer, a selected weight amount, and selected portions of a body to be weighted. The method also includes providing a garment and placing a plurality of weights in spaced relationship with the garment in accordance with the predetermined weight distribution. By distributing the predetermined weight about the garment in this manner, the intended wearer receives more optimal results in muscle system performance, strength, and stamina enhancement. The present description can be better understood with reference to the attached figures and to the following non-limiting examples.

Figure 1:
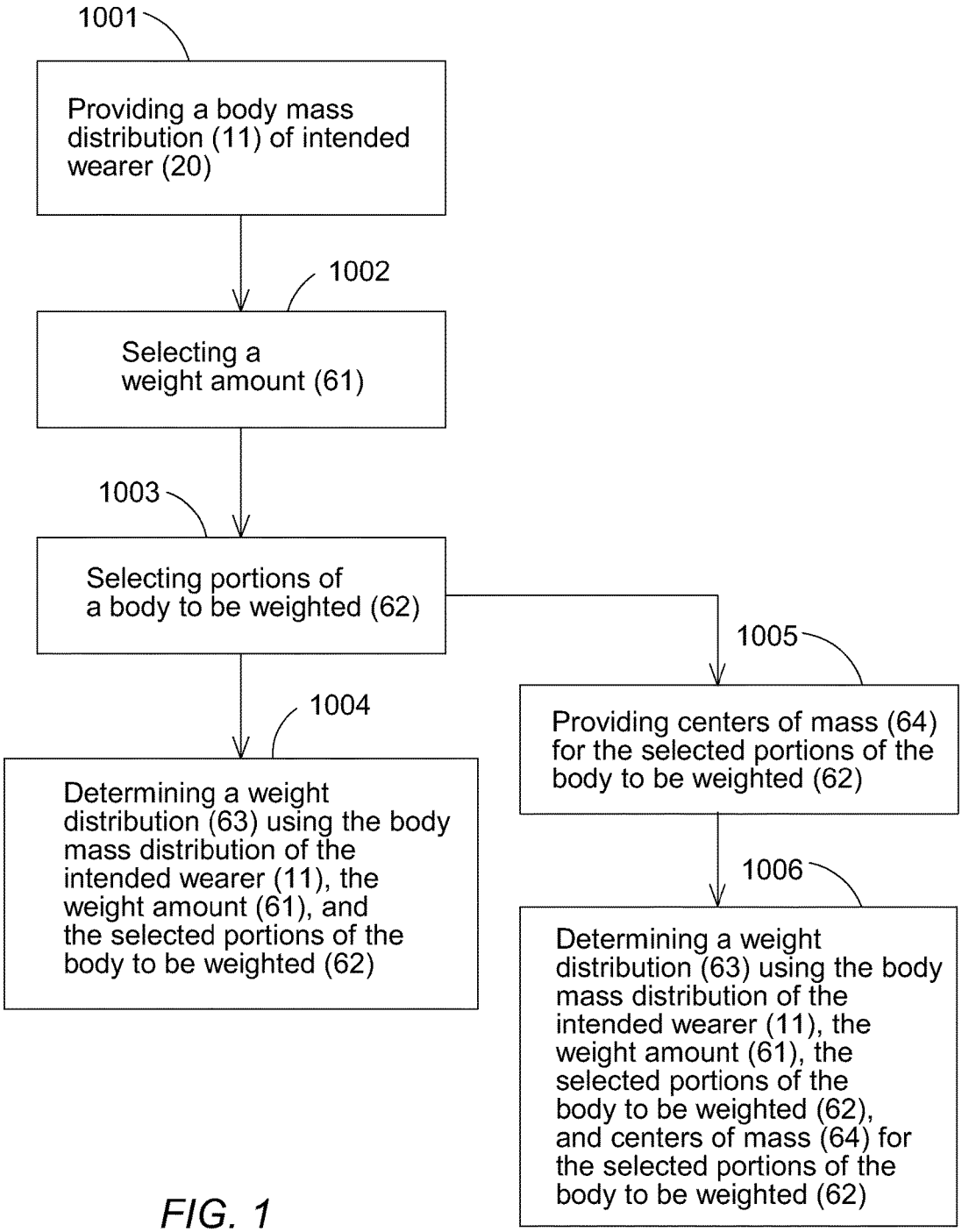
FIG. 1 illustrates a flow diagram for forming a weighted garment in accordance with embodiments of the present invention.
Figure 3:
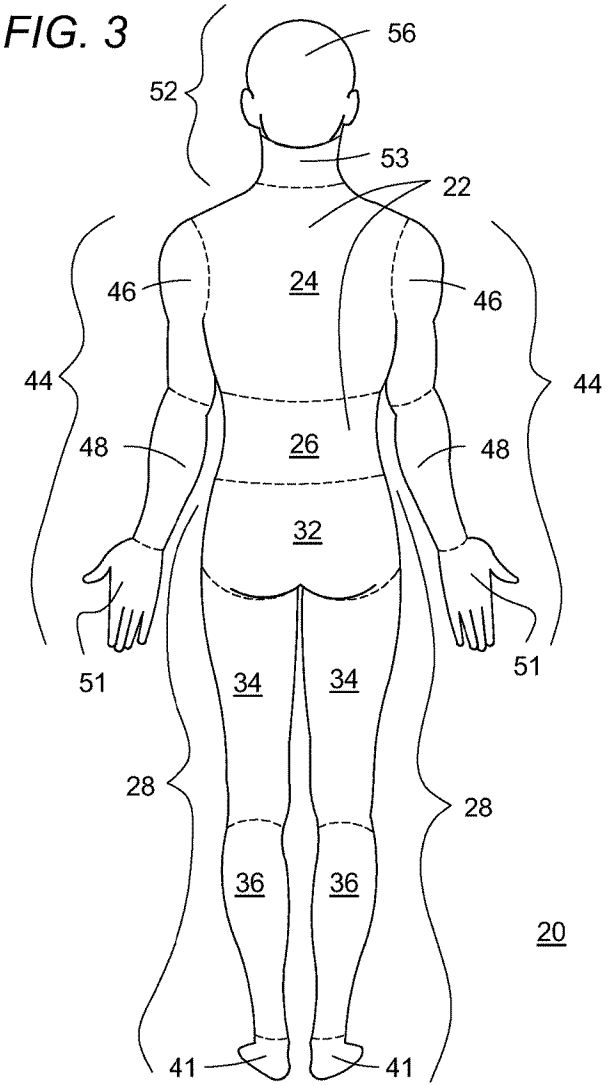
FIG. 3 illustrates a rear view of a body of an intended wearer of a weighted garment formed in accordance with an embodiment of the present invention.
Figure 2:
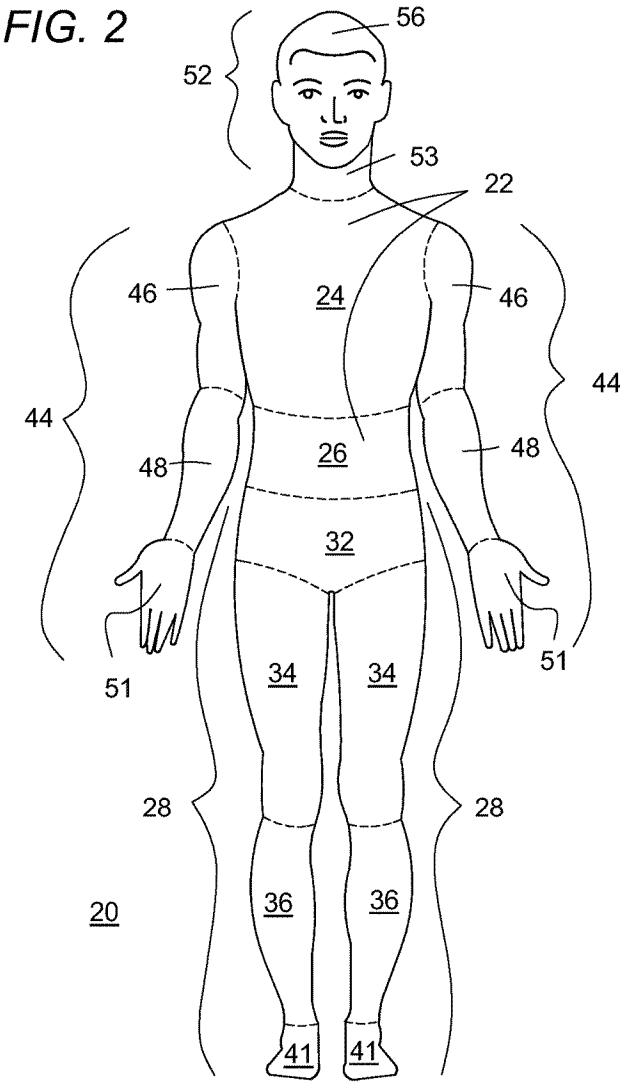
FIG. 2 illustrates a front view of a body of an intended wearer of a weighted garment formed in accordance with an embodiment of the present invention.

FIG. 1 is a flow-chart diagram that sets forth steps for forming a weighted garment. In step 1001, a body mass distribution 11 is established for an intended wearer. For a typical human adult male of about 24 years of age, the following example of body mass distribution 11 may be used with reference to FIGS. 2 and 3, which are frontal and rear views (respectively) in perspective of a body of an intended wearer 20. In FIGS. 2 and 3 and similar FIGS. that follow, the dashed lines represent approximate dividing or segment lines between the noted portions or body segments. In this example, about 35% to about 39% of body mass may be within a central body portion 22, which as designated includes a thorax region 24 and an abdominal region 26. Specifically, about 21% to about 23% of the body mass may be within thorax region 24, and about 14% to about 16% of the body mass may be within abdominal region 26.

Also, about 42% to about 49.5% of the body mass may be within the lower extremity portion 28, which as designated includes a pelvic region 32, thigh regions 34, calf regions 36, and foot regions 41. Specifically, about 13% to about 15% of the body mass may be within pelvic region 32, about 19% to about 21% of the body mass may be within thigh regions 34, about 8% to about 10% of the body mass may be within calf regions 36, and about 2% to about 3.5% of the body mass may be within foot regions 41.

Additionally, about 9% to about 15% of the body mass may be within upper extremity portions 44, which as designated, includes upper arm regions 46, forearm regions 48, and hand regions 51. Specifically, about 5% to about 7% of the body mass may be within upper arm regions 46, about 3% to about 5% of the body mass may be within forearm regions 48, and about 1% to about 3% may be within hand regions 51. In addition, about 5% to about 9.5% of the body mass may be within head portion 52, which as designated includes a neck region 53 and head region 56. Specifically, about 1% to about 3% of the body mass may be within neck region 53, and about 4% to about 6.5% may be within head region 56.

For a typical human adult female of about 19 years of age, the following example of body mass distribution 11 may be used with reference to FIGS. 2 and 3. About 32.5% to about 37% of body mass may be within a central body portion 22, which as designated includes a thorax region 24 and an abdominal region 26. Specifically, about 19.5% to about 22.0% of the body mass may be within thorax region 24, and about 13% to about 15% of the body mass may be within abdominal region 26.

Also, about 44% to about 51.5% of the body mass may be within the lower extremity portion 28, which as designated includes a pelvic region 32, thigh regions 34, calf regions 36, and foot regions 41. Specifically, about 13.5% to about 15.5% of the body mass may be within pelvic region 32, about 19.5% to about 21.5% of the body mass may be within thigh regions 34, about 8.5% to about 10.5% of the body mass may be within calf regions 36, and about 1.5% to about 3% of the body mass may be within foot regions 41.

Additionally, about 7% to about 12% of the body mass may be within upper extremity portions 44, which as designated, includes upper arm regions 46, forearm regions 48, and hand regions 51. Specifically, about 4.5% to about 6% of the body mass may be within upper arm regions 46, about 1.75% to about 3.5% of the body mass may be within forearm regions 48, and about 0.75% to about 2.5% may be within hand regions 51. In addition, about 4.5% to about 7.5% of the body mass may be within head portion 52, which as designated, includes a neck region 53 and head region 56. Specifically, about 0.75% to about 2.5% of the body mass may be within neck region 53, and about 3.75% to about 5% may be within head region 56. For the non-limiting examples that follow, the weight distribution of typical adult male will be used, but it is understood that actual weight distributions for individual applications or intended wearers are intended to be used in other embodiments.

With reference back to FIG. 1, in step 1002 a weight amount 61 to be placed on an exercise garment or garment 68 is determined or selected. By way of example, weight amount 61 may be selected in accordance with the fitness level of intended wearer 20 and/or the degree to which intended wearer 20 desires to exercise. Various weight amounts 61 will be discussed in the examples that follow. In step 1003, portions 62 of the body of intended wearer 20 to be weighted are selected. By way of example, portions 62 may include central body portion 22, lower extremity portion 28, upper extremity portions 44, neck portion 53, and/or head portion 56, portions thereof, or sub-portions thereof. Various configurations of portions 62 will be discussed in the examples that follow.

In step 1004, a weight distribution 63 is determined using body mass distribution 11 of intended wearer 20, weight amount 61, and portions 62 selected to be weighted. Weight distribution 63 is a result that corresponds to a distribution map or guide for placing or attaching portions of weight amount 61 onto garment 68 in an optimal manner for enhanced or improved exercise.

By way of example, the following parameters and relationships may be used to calculate weight distribution 63 with reference to the table shown in FIG. 4, which corresponds to a mass or weight distribution model that may be used for configuring garment 68. The body of intended wearer 20 may be split, for example, into four (4) parts or sub-parts designated as "Parts" in column A of FIG. 4. For example, a first part (Part 1) includes central body portion 22, a second part (Part 2) includes lower extremity portions 28, a third part (Part 3) includes upper extremity portions 44, and a fourth part (Part 4) includes head portion 52. Each part may then be configured to cover or include specific sub-regions designated as "Regions" in column B of FIG. 4. For example, the first part or Part 1 includes thorax region 24 (Region 1*a*) and abdominal region 26 (Region 2*a*); the second part or Part 2 includes pelvic region 32 (Region 3*a*), thigh regions 34 (Region 4*a*), calf regions 36 (Region 5*a*), and foot regions 41 (Region 6*a*); the third part or Part 3 includes upper arm regions 46 (Region 7*a*), forearm regions 48 (Region 8*a*), and hand regions 51 (Region 9*a*); and the fourth part or Part 4 includes neck region 53 (Region 10*a*) and head region 56 (Region 11*a*).

Column C of FIG. 4 corresponds to the proportion of the total mass amount that may be assigned to a specific Part, which may be designated as coefficient Kp. Coefficient Kp corresponds to the average mass distribution for a typical human male of about 24 years of age as described above in conjunction with FIGS. 2 and 3, and can be adjusted in accordance with specific body mass distribution details associated with intended wearer 20. For example, the coefficient Kp for Part 1 can be about 0.37, the coefficient Kp for Part 2 can be about 0.45, the coefficient Kp for Part 3 can be about 0.10, and the coefficient Kp for Part 4 can be about 0.08. Column D of FIG. 4 corresponds to the proportion or percentage of a specific Kp that is assigned to a specific Region, which may be designated as coefficient Kpr. Specifically, coefficient Kpr corresponds to the proportion or percentage of the average mass distribution for a specific Part that is within a specific Region. Coefficient Kpr corresponds to the average mass distribution for a typical human male of 24 years of age as described above in conjunction with FIGS. 2 and 3 for specific Regions 1*a*-11*a*, and can be adjusted in accordance with specific body mass distribution information associated with intended wearer 20.

For example, the coefficient Kpr for Region 1*a* can be about 0.60, the coefficient Kpr for Region 2*a* can be about 0.40, the coefficient Kpr for Region 3*a* can be about 0.30, the coefficient Kpr for Region 4*a* can be about 0.45, the coefficient Kpr for Region 5*a* can be about 0.19, the coefficient Kpr for Region 6*a* can be about 0.06, the coefficient Kpr for Region 7*a* can be about 0.55, the coefficient for Region 8*a* can be about 0.33, the coefficient for Region 9*a* can be about 0.12, the coefficient Kpr for Region 10*a* can be about 0.26, and the coefficient for Region 11*a* can be about 0.74. It is understood that the above numbers assigned to the coefficients may be adjusted based on the pre-determined mass distribution of a specific intended wearer and that the above numbers represent those that are average or typical for a human male of about 24 years of age.

Column E of FIG. 4 corresponds to the average total mass distribution assigned to specific Regions, and may be designated as Kr, where:

$$Kr=Kp\times Kpr \quad (1)$$

Column F corresponds to a variable or selectable parameter that corresponds to designated portions of garment 68 to be weighted. Alternatively, Column F corresponds to those portions of the body of intended wearer 20 to be covered and/or weighted. Column G corresponds to a configured weight Region distribution result and may be designated as coefficient Kpr cfg (or Kpr "configured"), which carries from Column F for those Regions selected to be weighted. The results of Column G sum to a variable that can be designated as Mcv or body mass distribution coverage, which is an amount between zero (0) and one (1.0), where:

$$Mcv=\Sigma Kr\ cfg \quad (2)$$

Column H of FIG. 4 is a distributed weight amount for the selected Regions, which is determined using a loaded weight (LW) or weight amount 61 and a gross weight (GW), where:

$$GW=LW/Mcv \quad (3)$$

To calculate the weight amount for selected Regions, the Kr cfg for each selected Region is multiplied by GW. In FIG. 4, LW (total weight 61) is selected, for example, to be 20 lbs (9 kg). All Regions are selected; thus Mcv is equal to 1.0, and GW equals LW/1.0 or 20 lbs. The weight amount for each selected Region is the GW (20 lbs) times the respective Kr cfg. With this selected total weight 61, about 4.4 lbs (2.0 kg) (20 lbs×0.222) may be placed within thorax region 24, about 3.0 lbs (1.36 kg) (20 lbs×0.148) may be placed within abdominal region 26, about 2.7 lbs (1.2 kg) (20 lbs×0.135) may be placed within pelvic region 32, about 4.1 lbs (1.86 kg) (20 lbs×0.203) may be placed within thigh regions 34, about 1.7 lbs (0.8 kg) (20 lbs×0.086) may be placed within calf regions 36, about 0.5 lbs (0.23 kg) (20 lbs×0.027) may be placed within foot regions 41, about 1.1 lbs (0.5 kg) (20 lbs×0.055) may be placed within upper arm regions 46, about 0.7 lbs (0.3 kg) (20 lbs×0.033) may be placed within forearm regions 48, about 0.2 lbs (0.1 kg) (20 lbs×0.012) may be placed within hand regions 51, about 0.4 lbs (0.2 kg) (20 lbs×0.021) may be placed within neck region 53, and about 1.2 lbs (0.6 kg) (20 lbs×0.059) may be placed within head region 56.

Figure 5:
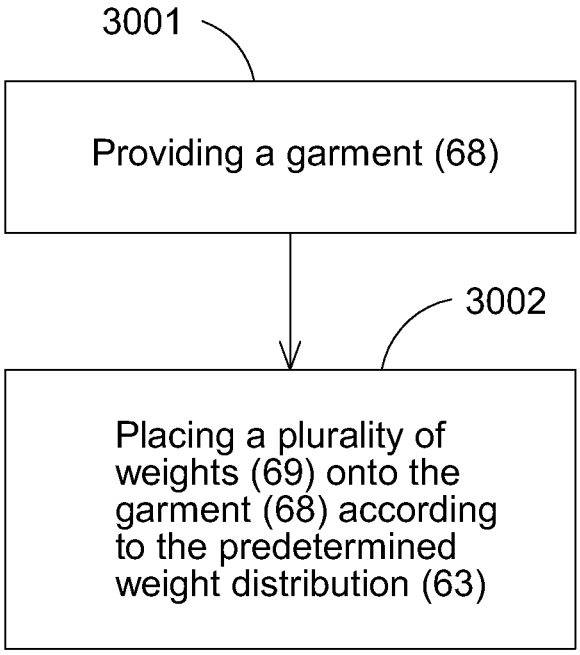
FIG. 5 illustrates a flow diagram for forming a weighted garment in accordance with other embodiments of the present invention.

FIG. 5 is a flow-chart diagram of subsequent steps in forming a weighted garment. In step 3001, a suit, such as garment 68, is selected for weighting. By way of example, garment 68 comprises a material that closely and comfortably conforms to the body of intended wearer 20. Such materials may include, but are not limited to, cotton, polyester, spandex, nylon, neoprene, or combinations thereof such as Dry-Fit® brand material or Lycra® brand material. In step 3002, a plurality of weights 69 are placed in spaced relationship with garment 68 in accordance with weight distribution 63 as described in conjunction with FIG. 4. By way of example, plurality of weights 69 may be sewn into the fabric of garment 68, may be attached in pockets associated with garment 68, or may be attached to an outer surface of garment 68 using glue, Velcro® brand fasteners, snaps, stitching, or the like. Additionally, it is understood that weighting for foot regions 42 may be done by placing selected weight portions onto shoes worn by wearer 20.

Plurality of weights 69 may comprise weighted moldable structures of convenient weight amount and shape. In one embodiment, plurality of weights 69 may be thin cylinders of lead shot or BB's held together with a binding medium or matrix material, such as silicon, epoxy, or polyurethane. In a preferred embodiment, lead shot or BB's of about ⅛ inch diameter can be encapsulated and cured in a flexible silicon matrix to form the plurality of weights. Such an embodiment allows the plurality of weights to be subtle and flexible as an aid to prevent injury to the intended wearer in the event of an inadvertent fall or tumble. The thin cylinders may be trimmed for desired weight and for optimum placement on garment 68.

Referring back to FIG. 1 and in an alternative embodiment, predetermined centers of mass 64 for the selected portions of body to be weighted 62 can be optionally provided as shown in step 1005. In one embodiment, the centers of mass 64 are measured specifically for intended wearer 20. By way of example, for a mid-size human male of 178.4 cm in stature, the centers of mass 64 may be determined as follows. The center of mass for head region 56 may be about 10.5 cm measured downward from the top of the head, or about 167.9 cm measured upward from the bottom of the feet, and about 10.4 cm measured inward from the back of the head. The center of mass for neck region 53 may be about 23.9 cm measured downward from the top of the head, or about 154.5 cm measured upward from the bottom of the feet. The center of mass for thorax region 24 may be about 22.3 cm measured downward from the top segment line for central body portion 22 (i.e., measured downward from the cervicale, which is the superior point on the spinous process of the 7th cervical vertebrae or the neck/thorax pivot), or about 130.8 cm measured upward from the bottom of the feet. The center of mass for abdominal region 26 may be about 43.2 cm measured downward from the top segment line for central body portion 22 (i.e., measured downward from the cervicale or neck/thorax pivot), or about 109.9 cm measured upward from the bottom of the feet. The center of mass for pelvic region 32 may be about 9.0 cm measured downward from the top segment line for lower extremity portion 28 (i.e., measured downward from the line horizontal to the level of the iliocristale, which is a point in the midaxillary line on the crest of the ilium about midway between the superior and lateral margins of the crest), or about 98.3 cm measured upward from the bottom of the feet. The centers of mass for thigh regions 34 may be about 19.6 cm measured downward from the lower segment line (i.e., measured downward from the trochanterion, which is the highest point of the greater trochanter (a large blunt bony process on the lateral side of the proximal end of the femur), or from the hip pivot) for pelvic region 32, or about 75 cm measured upward from the bottom of the feet. The centers of mass for calf regions 36 may be about 17.5 measured downward from the lower segment line (i.e., measured downward from the knee pivot) of thigh portions 34, or about 33.0 cm measured upward from the bottom of the feet. The centers of mass for foot regions 41 may be about 2.8 cm measured upward from the bottom of the feet and about 11.1 cm measured inward from the heel. The centers of mass for upper arm regions 46 may be about 17.7 cm downward from the acromion process of the shoulder blade, which is the lateral point on the bony tip of the shoulder. The centers of mass for forearm regions 48 may be about 43.5 cm measured downward from the acromion process, and the centers of mass for hand regions 51 may be about 67 cm measured downward from the acromion process.

By way of another example, for a typical human male, the centers of mass 64 may be determined as follows. The center of mass for head region 56 may be about 94% of the wearer's height as measured from the bottom of the wearer's feet. For example, for a human of 180 cm in height, the center of mass for head region 56 may be about 169.2 cm from the bottom of the feet. The center of mass for neck region 53 may be about 86.5% of the height as measured from the bottom of the feet. The center of mass for thorax region 24 may be about 73.3% of the height as measured from the bottom of the feet. The center of mass for abdominal region 26 may be about 61.5% of the height as measured from the bottom of the feet. The center of mass for pelvic region 32 may be about 55% of the height as measured from the bottom of the feet. The centers of mass for thigh regions 34 may be about 42% of the height as measured from the bottom of the feet. The centers of mass for calf regions 36 may be about 18.5% of the height as measured from the bottom of the feet. The centers of mass for foot regions 41 may be about 1.57% of the height as measured from the bottom of feet. The centers of mass for upper arm regions 46 may be about 22.3% of the length of the arm as measured starting from acromion process downward to the tip of the middle finger. For example, for an arm of 80 cm in length, the center of mass for upper arm regions 46 may be about 17.8 cm downward from the acromion process. The centers of mass for forearm regions 48 may be about 54.6% of the length of the arm downward from the acromion process, and the centers of mass for hand regions 51 may be about 84.2% of the length of arm downward from the acromion process. Thus, the determined weight distribution 63 may be further distributed within the selected portions of body to be weighted 62 to conform to the predetermined centers of mass 64 of the intended wearer, as shown in step 1006.

In one embodiment, the weight distribution for a selected portion of the body to be weighted is placed approximately one-half above and approximately one-half below a horizontal plane that contains that body segment's center of mass. In another embodiment, the weight distribution for a selected portion of the body to be weighted is placed equally distributed about that body segment's center of mass. By distributing the determined weight distribution 63 in accordance with the predetermined centers of mass 64, the weighted garment 68 can be loaded on the intended wearer 20 in a further balanced and more natural manner; thus reducing undue stress and strain to the muscle system.

Example 1

Figures 6, 7:
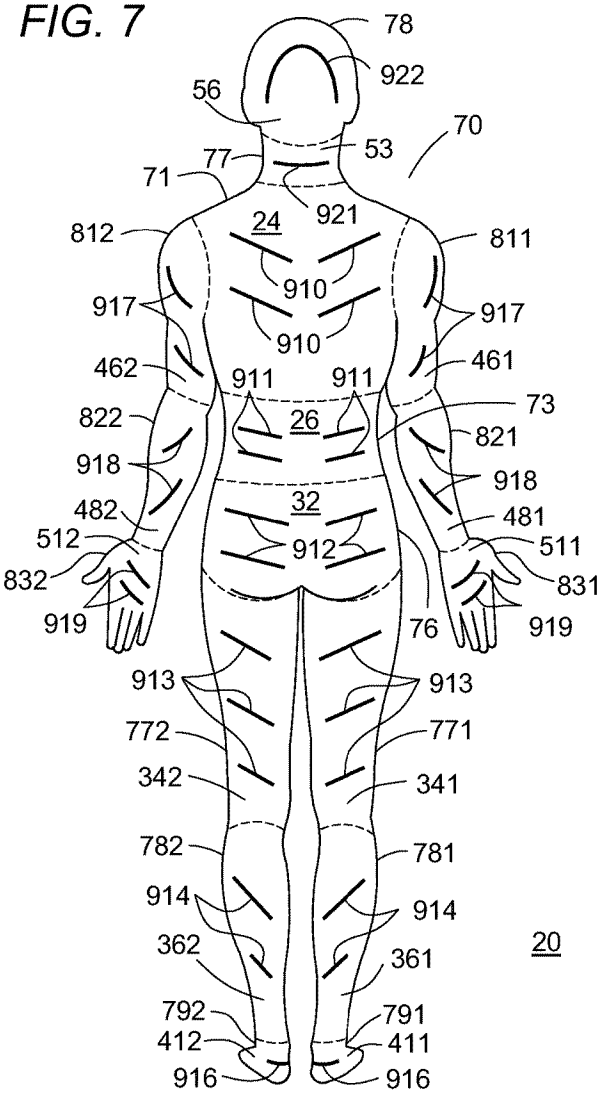
FIG. 6 illustrates a front view of weighted garment in accordance with a first embodiment of the present invention worn by an intended wearer.
FIG. 7 illustrates a rear view of the first embodiment.

FIGS. 6 and 7 are front and back (respectively) plan views of a weighted exercise garment 70 in accordance with a first embodiment worn by intended wearer or wearer 20. Weighted garment 70 may be multiple pieces or may be a single piece. In this embodiment, intended wearer 20 is a human male of about 24 years of age. In alternative embodiments, intended wearer 20 can be a human female or a non-human, such as a dog, horse, or any animal that would benefit from weight-balanced exercise with the mass distribution information determined and modified accordingly.

In this embodiment, weighted exercise garment 70 is a full-body configured garment and includes a part 71 that is configured for covering thorax portion 24 of wearer 20 when placed thereon. Weighted exercise garment 70 also includes a part 73 for covering abdominal region 26, a part 76 for covering pelvic region 32, a part 771 for covering a thigh region 341, and a part 772 for covering a thigh region 342 of wearer 20. Weighted exercise garment 70 additionally includes a part 781 for covering a calf region 361, a part 782 for covering a calf region 362, a part 791 for covering a foot region 411, and a part 792 for covering a foot region 412 of wearer 20. Weighted exercise garment 70 further includes a part 811 for covering an upper arm region 461, a part 812 for covering an upper arm region 462, a part 821 for covering a forearm region 481, a part 822 for covering a forearm region 482, a part 831 for covering a hand region 511, a part 832 for covering hand region 512, a part 77 for covering neck region 53, and a part 79 for covering head portion 56 of intended wearer 20.

A plurality of weights is distributed about garment 70 in proportion to a body mass distribution 11 of wearer 20. By way of example, the plurality of weights may be equally or symmetrically distributed about garment 70 in accordance with a calculated mass or weight distribution model such as weight distribution 63. By way of example and with reference back to FIG. 4, the plurality of weights may sum to a weight amount 61 of 20 lbs (GW=LW=20 lbs). In this example, the plurality of weights may include a portion 910 of about 4.4 lbs that is distributed within part 71, a portion 911 of about 3.0 lbs that is distributed within part 73, a portion 912 of about 2.7 lbs that is distributed within part 76, and a portion 913 of about 4.1 lbs that is distributed within parts 771 and 772. In one embodiment, portion 913 may be split equally between parts 771 and 772. In another embodiment, portion 913 may be unequally split between parts 771 and 772 if one region needs more or less work depending on the needs of wearer 20 (for example, recovery from injury or focused muscle development). The plurality of weights may include a portion 914 of about 1.7 lbs that is distributed within parts 781 and 782 and a portion 916 of about 0.5 lbs that is distributed within parts 791 and 792. In one embodiment, portion 914 may be split equally between parts 781 and 782. In another embodiment, portion 914 may be unequally split between parts 781 and 782. In one embodiment, portion 916 may be split equally between parts 791 and 792. In another embodiment, portion 916 may be unequally split between parts 791 and 792.

The plurality of weights may include a portion 917 of about 1.1 lbs that is distributed within parts 811 and 812, a portion 918 of about 0.7 lbs this distributed within parts 821 and 822, and a portion 919 of about 0.2 lbs that is distributed within parts 831 and 832. In one embodiment, portion 917 may be split equally between parts 811 and 812. In another embodiment, portion 917 may be unequally split between parts 811 and 812. In one embodiment, portion 918 may be split equally between parts 821 and 822. In another embodiment, portion 918 may be unequally split between parts 821 and 822. In one embodiment, portion 919 may be split equally between parts 831 and 832. In another embodiment, portion 919 may be unequally split between parts 831 and 832. The plurality of weights may include a portion 921 of about 0.4 lbs that is distributed within part 77 and a portion 922 of about 1.2 lbs that is distributed within part 78.

In one embodiment, in garment 70 about 19.5% to about 23% of the total weight is distributed about thorax region 24, about 13% to about 16% of the total weight is distributed about abdominal region 26, about 13% to about 16% of the total weight is distributed about pelvic region 32, about 19% to about 22% of the total weight is distributed about thigh regions 34, about 8% to about 11% of the total weight is distributed about calf regions 36, about 1.5% to about 3.5% of the total weight distribution is distributed about foot regions 41, about 4% to about 7% of the total weight is distributed about upper arm regions 46, about 1.75% to about 5% of the total weight is distributed about forearm regions 48, about 0.75% to about 3% of the total weight is distributed about hand regions 51, about 0.75% to about 3% of the total weight is distributed about neck region 53, and about 3.75% to about 6.7% of the total weight is distributed about the at least part of the head region 56. The above percentages can be calculated by dividing the Region weight in Column H of FIG. 4 by LW and account for variations in typical body mass distribution information.

Example 2

Figure 9:
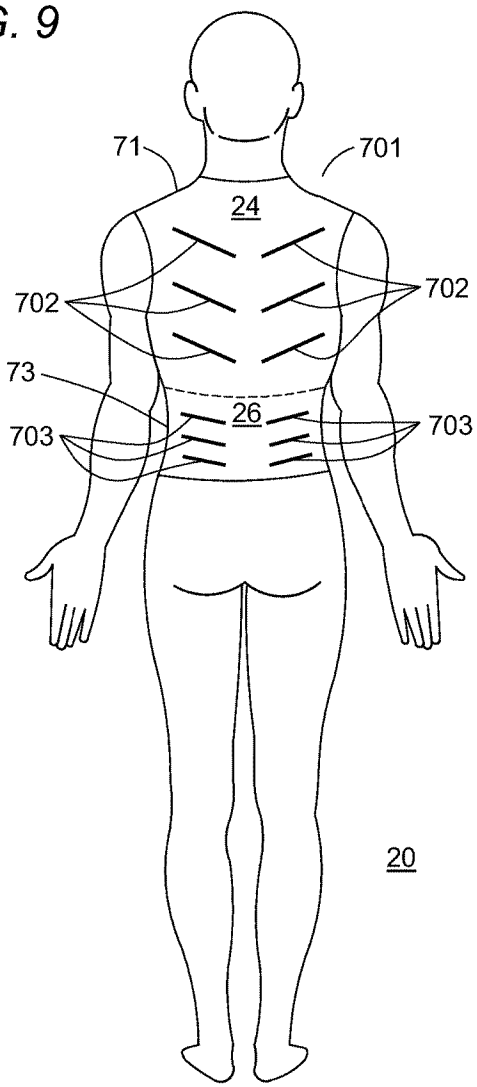
FIG. 9 illustrates a rear view of the second embodiment.
Figure 8:
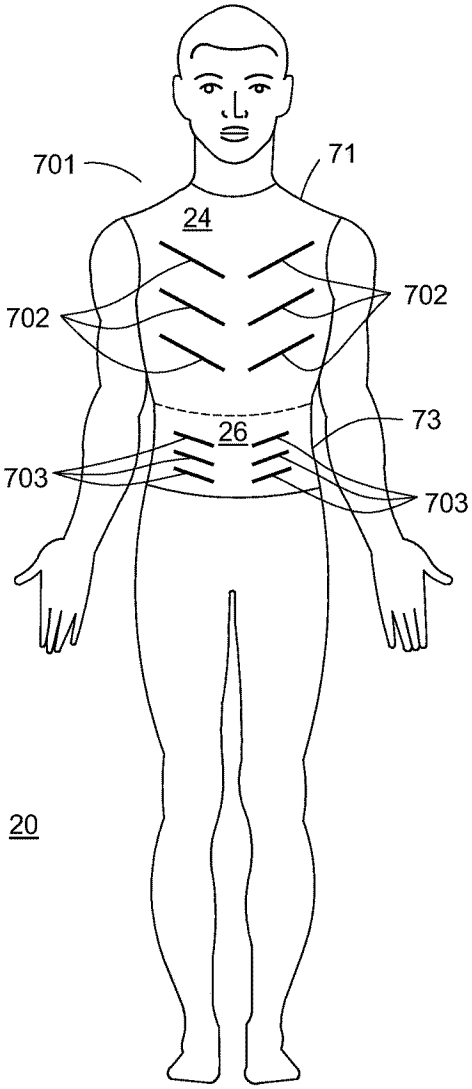
FIG. 8 illustrates a front view of a weighted garment in accordance with a second embodiment of the present invention worn by an intended wearer.

FIGS. 8 and 9 are front and back (respectively) plan views of a weighted exercise garment 701 in accordance with a second embodiment worn by intended wearer 20 or another wearer. In this embodiment, weighted garment 701 may be a partial suit that covers selected regions or body portions of intended wearer 20, or weighted garment 701 may be a full-body suit that has only selected parts that are weighted. In FIGS. 8 and 9, only a partial suit is shown for ease of understanding. In this embodiment, weighted garment 701 includes at least parts 71 and 73, which are also weighted.

For this example, a weight amount 61 of 10 lbs (4.5 kg) may be selected with reference to FIG. 10, which is a table that corresponds to a mass or weight distribution model such as weight distribution 63 for configuring this embodiment. FIG. 10 is similar to FIG. 4 except that only thorax region 24 and abdominal region 26 are selected in Column F with an "x" for the selected garment configuration. In this configuration, LW=10 lbs, Mcv=0.37, and GW=27.03. This mass distribution model places about 6 lbs (27.03 lbs×0.222) in part 71 and about 4 lbs (27.03 lbs×0.148) in part 73.

In one embodiment, in garment 701 about 58% to about 62% of the total weight 61 amount is distributed about thorax region 24, and about 38% to about 42% of the total weight amount is distributed about abdominal region 26.

A plurality of weights is distributed about garment 701 in proportion to a body mass distribution of wearer 20 and in accordance with those portions selected to receive weight. By way of example and with reference to FIG. 10, the plurality of weights may be equally or symmetrically distributed about garment 701 in accordance with a calculated weight distribution, such as weight distribution 63. In this embodiment, the plurality of weights includes a portion 702 of about 6 lbs distributed within part 71 and a portion 703 of about 4 lbs distributed within part 73.

Example 3

Figure 12:
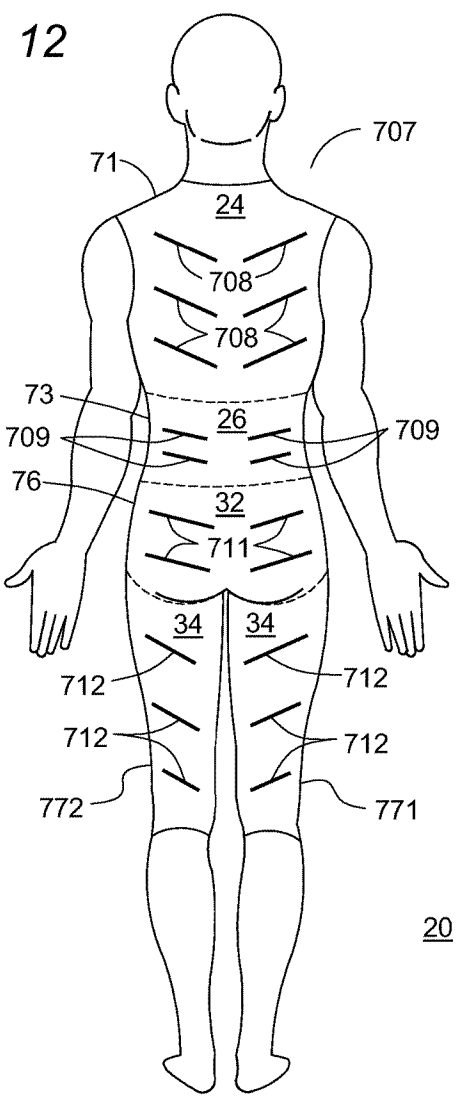
FIG. 12 illustrates a rear view of the third embodiment.
Figure 11:
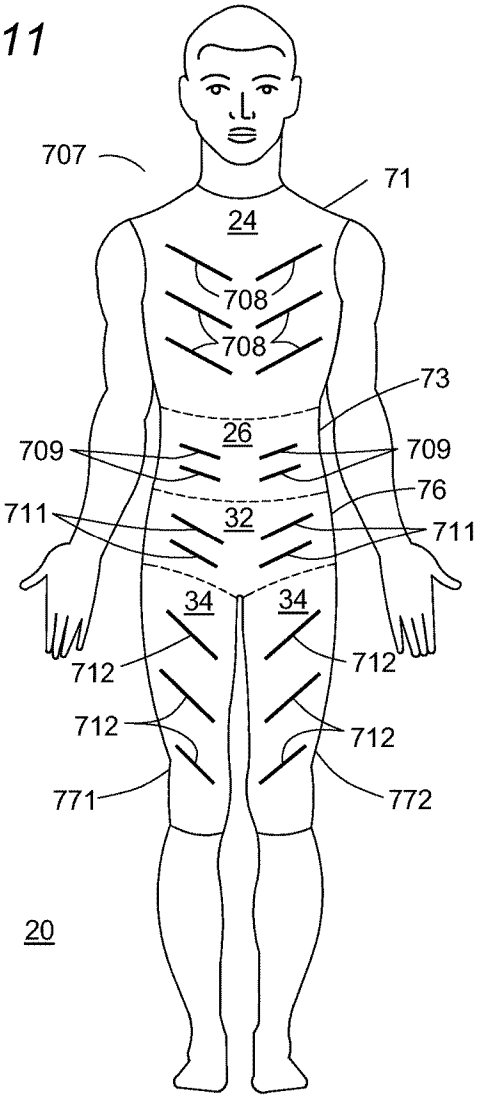
FIG. 11 illustrates a front view of weighted garment in accordance with a third embodiment of the present invention worn by an intended wearer.

FIGS. 11 and 12 are front and back (respectively) plan views of a weighted exercise garment 707 in accordance with a third embodiment worn by intended wearer 20 or another wearer. In this embodiment, weighted garment 707 may be a partial suit that covers selected regions or body portions of intended wearer 20, or weighted garment 707 may be a full-body suit that has only selected parts that are weighted. In FIGS. 11 and 12, only a partial suit is shown for ease of understanding. In this embodiment, weighted garment 707 includes at least parts 71, 73, 76, 771, and 772, which are also weighted.

For this example, a weight amount 61 of 15 lbs (6.8 kg) may be selected with reference to FIG. 13, which is a table that corresponds to a mass or weight distribution model, such as weight distribution 61, for configuring this embodiment. FIG. 13 is similar to FIG. 4 except that only thorax region 24, abdominal region 26, pelvic region 32 and thigh regions 34 are selected in Column F with an "x" for the selected garment configuration. In this configuration, LW=15 lbs, Mcv=0.71, and GW=21.2. This mass distribution model places about 4.7 lbs in part 71, about 3.1 lbs in part 73, about 2.9 lbs in part 76, and about 4.3 lbs split between parts 771 and 772. For example, about 2.15 lbs may be placed in each of parts 771 and 772.

In one embodiment, in garment 707 about 30% to about 34% of the total weight such as total weight 61 is distributed about thorax region 24, about 19% to about 23% of the total weight is distributed about abdominal region 26, about 17% to about 21% of the total weight is distributed about pelvic region 32, and about 27% to about 31% of the total weight is distributed about thigh regions 34.

A plurality of weights is distributed about garment 707 in proportion to a body mass distribution of wearer 20 and in accordance with those portions selected to receive weight. By way of example and with reference to FIG. 13, the plurality of weights may be equally or symmetrically distributed about garment 701 in accordance with a calculated weight distribution, such as weight distribution 63. In this embodiment, the plurality of weights includes a portion 708 of about 4.7 lbs distributed within part 71, a portion 709 of about 3.1 lbs distributed within part 73, a portion 711 of about 2.9 lbs distributed within part 76, and a portion 712 of about 4.3 lbs distributed within parts 771 and 772.

Example 4

Figure 15:
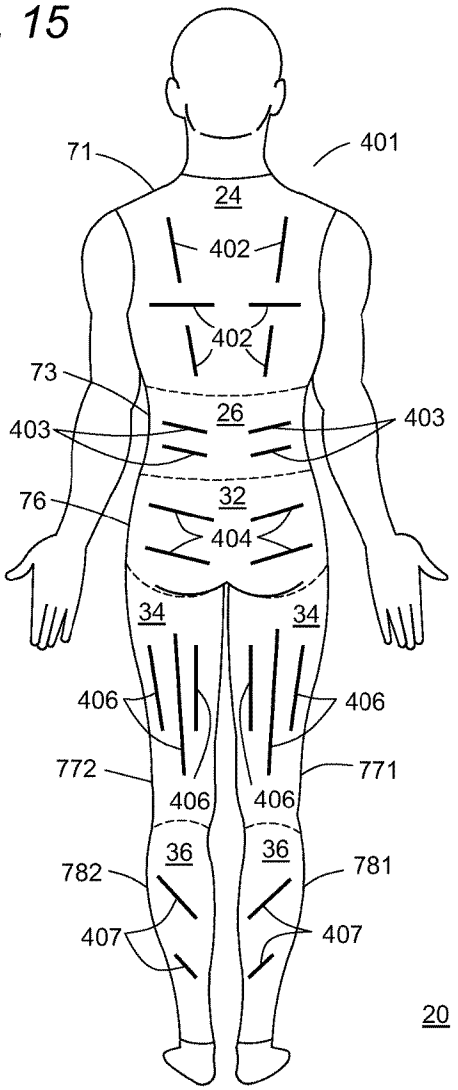
FIG. 15 illustrates a rear view of the fourth embodiment.
Figure 14:
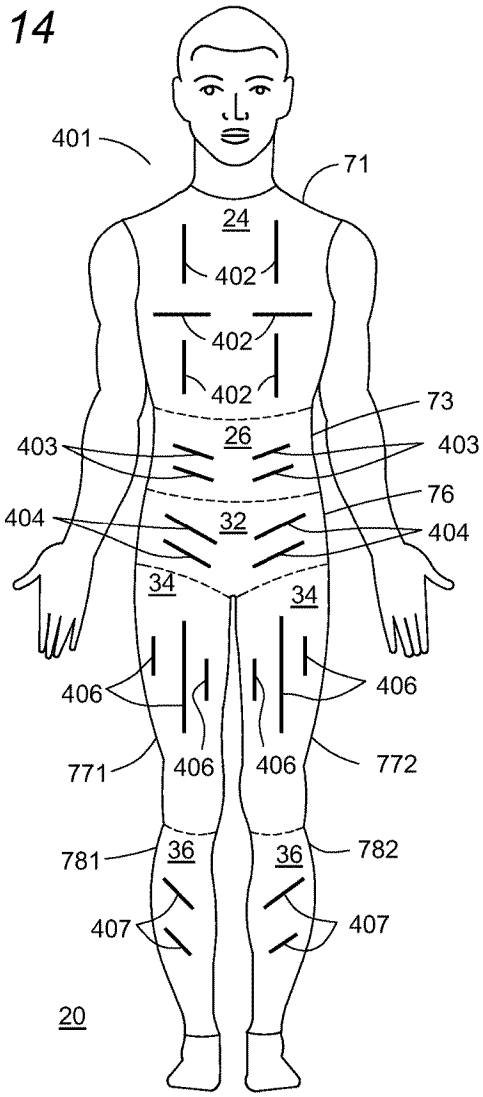
FIG. 14 illustrates a front view of weighted garment in accordance with a fourth embodiment of the present invention worn by an intended wearer.

FIGS. 14 and 15 are front and back (respectively) plan views of a weighted exercise garment 401 in accordance with a fourth embodiment worn by intended wearer 20 or another wearer. In this embodiment, weighted garment 401 may be a partial suit that covers selected regions or body portions of intended wearer 20, or weighted garment 401 may be a full-body suit that has only selected parts that are weighted. In FIGS. 14 and 15, only a partial suit is shown for ease of understanding. In this embodiment weighted garment 401 includes at least parts 71, 73, 76, 771, 772, 781 and 782, which are also weighted.

For this example, a weight amount 61 of 15 lbs (6.8 kg) may be selected with reference to FIG. 16, which is a table that corresponds to a mass or weight distribution model, such as weight distribution 61, for configuring this embodiment. FIG. 16 is similar to FIG. 4 except that only thorax region 24, abdominal region 26, pelvic region 32, thigh regions 34, and calf regions 36 are selected in Column F with an "x" for the selected garment configuration. In this configuration, LW=15 lbs, Mcv=0.79, and GW=18.92. This mass distribution model places about 4.2 lbs in part 71, about 2.8 lbs in part 73, about 2.6 lbs in part 76, and about 3.8 lbs split between parts 771 and 772. For example, about 1.9 lbs may be placed in each of parts 771 and 772. Also, in this configuration the mass distribution model places about 1.6 lbs in parts 781 and 782. For example, about 0.8 lbs may be placed in each of parts 781 and 782.

In one embodiment, in garment 401 about 25% to about 29% of the total weight, such as total weight 61, is distributed about thorax region 24, about 16% to about 20% of the total weight is distributed about abdominal region 26, about 15% to about 19% of the total weight is distributed about pelvic region 32, about 23% to about 27% of the total weight is distributed about thigh regions 34, and about 8% to about 12% of the total weight is distributed about calf regions 36.

A plurality of weights is distributed about garment 401 in proportion to a body mass distribution of wearer 20 and in accordance with those portions selected to receive weight. By way of example and with reference to FIG. 16, the plurality of weights may be equally or symmetrically distributed about garment 401 in accordance with a calculated weight distribution such as weight distribution 63. In this embodiment, the plurality of weights includes a portion 402 of about 4.2 lbs distributed within part 71, a portion 403 of about 2.8 lbs distributed within part 73, a portion 404 of about 2.6 lbs distributed within part 76, a portion 406 of about 3.8 lbs distributed within parts 771 and 772, and a portion 407 of about 1.6 lbs distributed within parts 781 and 782.

Example 5

Figure 18:
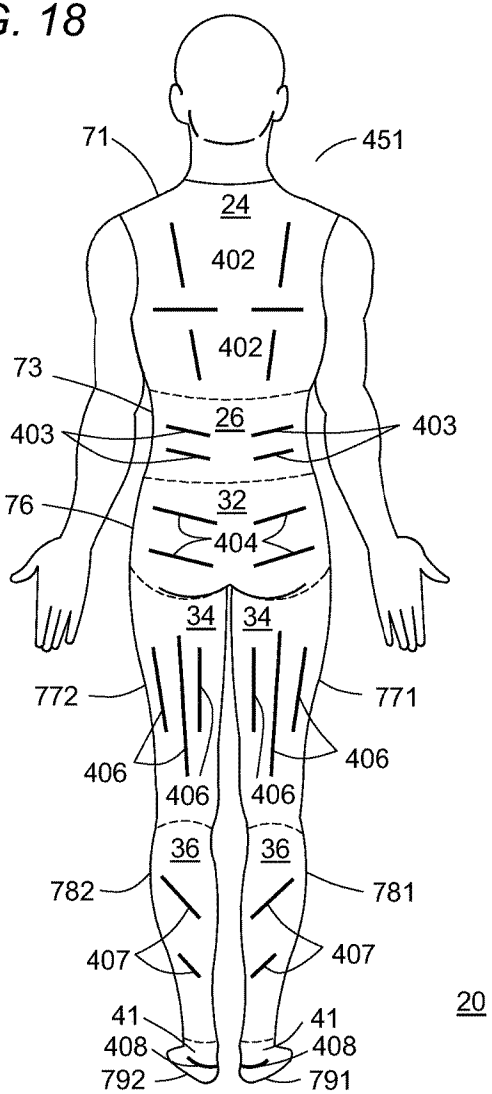
FIG. 18 illustrates a rear view of the fifth embodiment.
Figure 17:
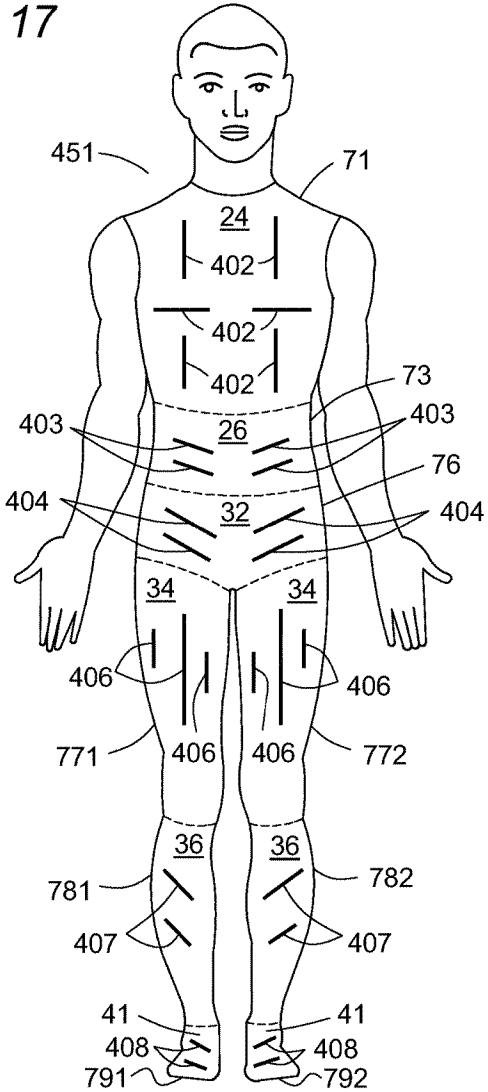
FIG. 17 illustrates a front view of weighted garment in accordance with a fifth embodiment of the present invention worn by an intended wearer.

FIGS. 17 and 18 are front and back (respectively) plan views of a weighted exercise garment 451 in accordance with a fifth embodiment worn by intended wearer 20 or another wearer. In this embodiment, weighted garment 451 may be a partial suit that covers selected regions or body portions of intended wearer 20, or weighted garment 451 may be a full-body suit that has only selected parts that are weighted. In FIGS. 17 and 18, only a partial suit is shown for ease of understanding. In this embodiment weighted garment 451 includes at least parts 71, 73, 76, 771, 772, 781, 782, 791, and 792, which are also weighted.

For this example, a weight amount of 20 lbs (9.0 kg) may be selected with reference to FIG. 19, which is a table that corresponds to a mass or weight distribution model, such as weight distribution 61, for configuring this embodiment. FIG. 19 is similar to FIG. 4 except that only thorax region 24, abdominal region 26, pelvic region 32, thigh regions 34, calf regions 36, and foot regions 41 are selected in Column F with an "x" for the selected garment configuration. In this configuration, LW=20 lbs, Mcv=0.82, and GW=24.39. This mass distribution model places about 5.4 lbs in part 71, about 3.6 lbs in part 73, about 3.3 lbs in part 76, and about 4.9 lbs split between parts 771 and 772. For example, about 2.45 lbs may be placed in each of parts 771 and 772. Also, in this configuration the mass distribution model places about 2.1 lbs in parts 781 and 782. For example, about 1.05 lbs may be placed in each of parts 781 and 782. Additionally, in this configuration the mass distribution model places about 0.7 lbs in parts 791 and 792. For example, about 0.35 lbs may be placed in each of parts 791 and 792.

In one embodiment, in garment 451 about 24% to about 28% of the total weight, such as total weight 61, is distributed about thorax region 24, about 15% to about 19% of the total weight is distributed about abdominal region 26, about 14% to about 18% of the total weight is distributed about pelvic region 32, about 22% to about 26% of the total weight is distributed about thigh regions 34, about 7% to about 11% of the total weight is distributed about calf regions 36, and about 2% to about 4% of the total weight is distributed about foot regions 41.

A plurality of weights is distributed about garment 451 in proportion to a body mass distribution of wearer 20 and in accordance with those portions selected to receive weight. By way of example and with reference to FIG. 19, the plurality of weights may be equally or symmetrically distributed about garment 451 in accordance with a calculated weight distribution such as weight distribution 63. In this embodiment, the plurality of weights includes a portion 402 of about 5.4 lbs distributed within part 71, a portion 403 of about 3.6 lbs distributed within part 73, a portion 404 of about 3.3 lbs distributed within part 76, a portion 406 of about 4.9 lbs distributed within parts 771 and 772, a portion 407 of about 2.1 lbs distributed within parts 781 and 782, and a portion 408 of about 0.7 lbs distributed within parts 791 and 792. It is understood that parts 791 and 792 may comprise shoes that receive the designated weight, or the shoes themselves may comprise the designated weight.

Example 6

Figure 21:
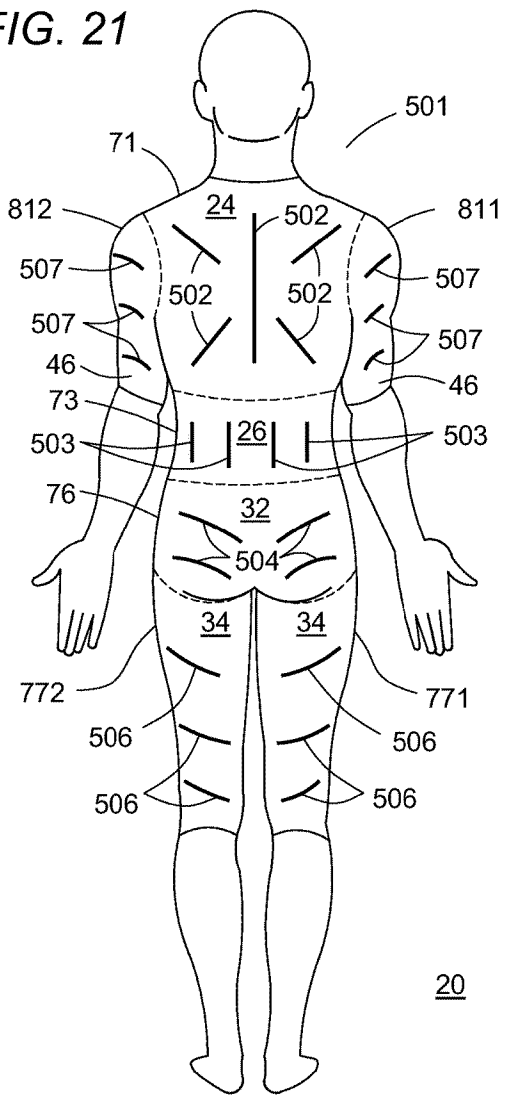
FIG. 21 illustrates a rear view of the sixth embodiment.
Figure 20:
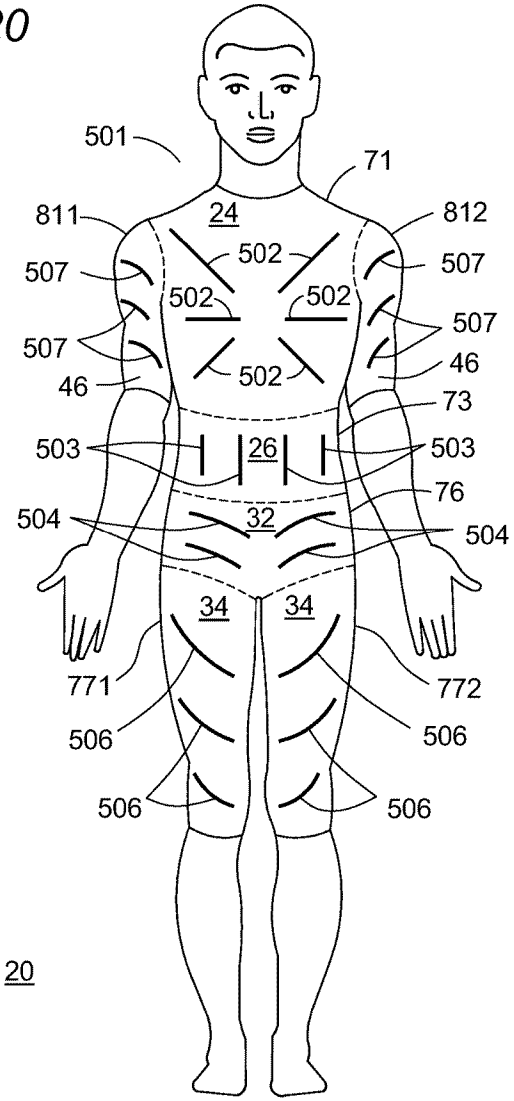
FIG. 20 illustrates a front view of weighted garment in accordance with a sixth embodiment of the present invention worn by an intended wearer.

FIGS. 20 and 21 are front and back (respectively) plan views of a weighted exercise garment 501 in accordance with a sixth embodiment worn by intended wearer 20 or another wearer. In this embodiment, weighted garment 501 may be a partial suit that covers selected regions or body portions of intended wearer 20, or weighted garment 501 may be a full-body suit that has only selected parts that are weighted. In FIGS. 20 and 21, only a partial suit is shown for ease of understanding. In this embodiment, weighted garment 501 includes at least parts 71, 73, 76, 771, 772, 811, and 812, which are also weighted.

For this example, a weight amount of 20 lbs (9.0 kg) may be selected with reference to FIG. 22, which is a table that corresponds to a mass or weight distribution model, such as weight distribution 61, for configuring this embodiment. FIG. 21 is similar to FIG. 4 except that only thorax region 24, abdominal region 26, pelvic region 32, thigh regions 34, and upper arm regions 46 are selected in Column F with an "x" for the selected garment configuration. In this configuration, LW=20 lbs, Mcv=0.76, and GW=26.23. This mass distribution model places about 5.8 lbs in part 71, about 3.9 lbs in part 73, about 3.5 lbs in part 76, and about 5.3 lbs split between parts 771 and 772. For example, about 2.65 lbs may be placed in each of parts 771 and 772. Additionally, in this configuration the mass distribution model places about 1.4 lbs in parts 811 and 812. For example, about 0.70 lbs may be placed in each of parts 811 and 812.

In one embodiment, in garment 501 about 27% to about 29% of the total weight, such as total weight 61, is distributed about thorax region 24, about 17% to about 21% of the total weight is distributed about abdominal region 26, about 16% to about 20% of the total weight is distributed about pelvic region 32, about 25% to about 29% of the total weight is distributed about thigh regions 34, and about 6% to about 9% of the total weight is distributed about upper arm regions 46.

A plurality of weights is distributed about garment 501 in proportion to a body mass distribution of wearer 20 and in accordance with those portions selected to receive weight. By way of example and with reference to FIG. 22, the plurality of weights may be equally or symmetrically distributed about garment 501 in accordance with a calculated weight distribution, such as weight distribution 63. In this embodiment, the plurality of weights includes a portion 502 of about 5.8 lbs distributed within part 71, a portion 503 of about 3.9 lbs distributed within part 73, a portion 504 of about 3.5 lbs distributed within part 76, a portion 506 of about 5.3 lbs distributed within parts 771 and 772, and a portion 507 of about 1.4 lbs distributed within parts 811 and 812.

Example 7

Figure 24:
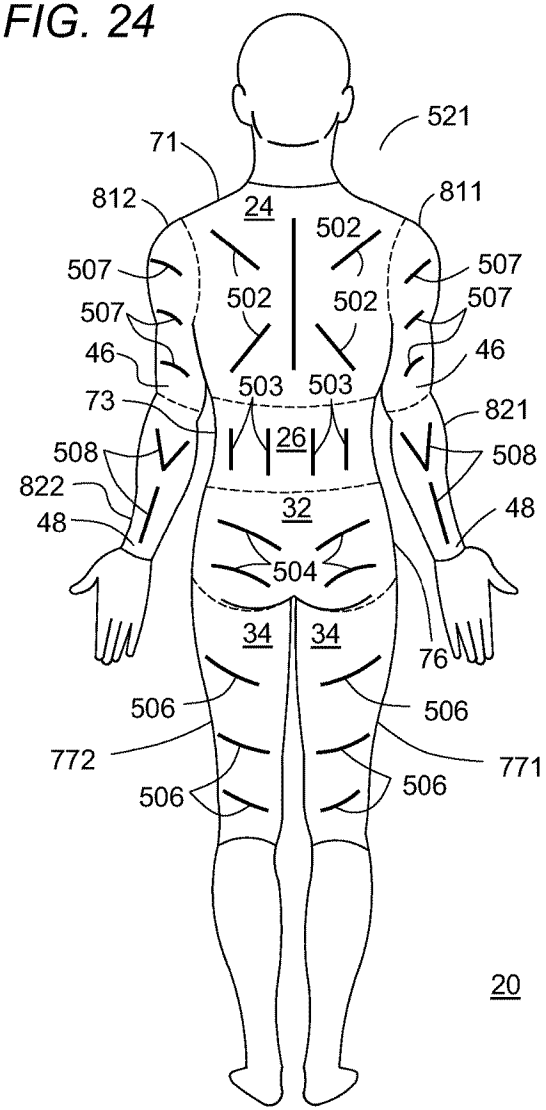
FIG. 24 illustrates a rear view of the seventh embodiment.
Figure 23:
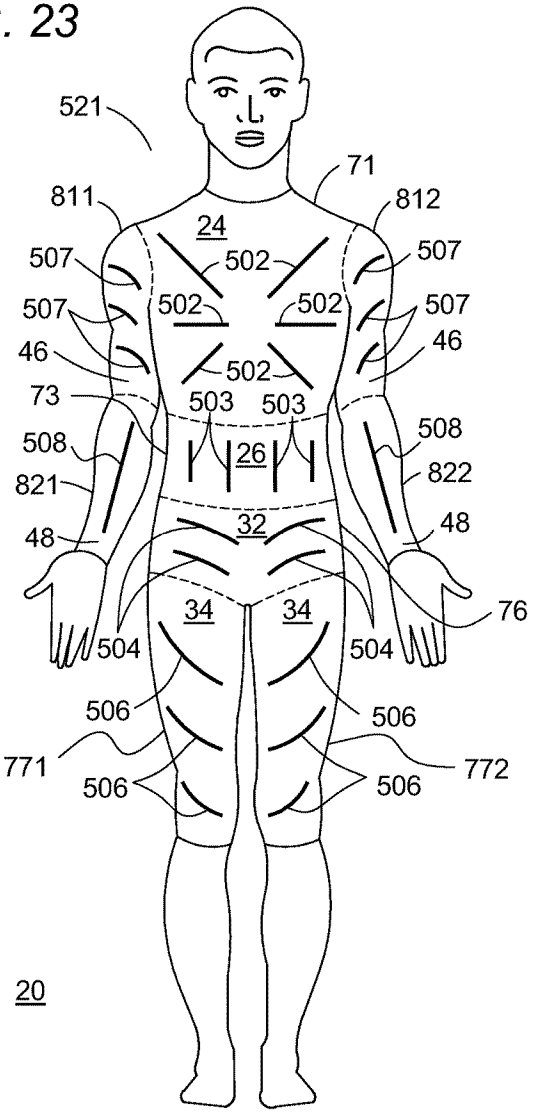
FIG. 23 illustrates a front view of weighted garment in accordance with a seventh embodiment of the present invention worn by an intended wearer.

FIGS. 23 and 24 are front and back (respectively) plan views of a weighted exercise garment 521 in accordance with a seventh embodiment worn by intended wearer or wearer 20. In this embodiment, weighted garment 521 may be a partial suit that covers selected regions or body portions of intended wearer 20, or weighted garment 521 may be a full-body suit that has only selected parts that are weighted. In FIGS. 23 and 24, only a partial suit is shown for ease of understanding. In this embodiment, weighted garment 521 includes at least parts 71, 73, 76, 771, 772, 811, 812, 821, and 822, which are also weighted.

For this example, a weight amount of 25 lbs (11.4 kg) may be selected with reference to FIG. 25, which is a table that corresponds to a mass or weight distribution model, such as weight distribution 61, for configuring this embodiment. FIG. 25 is similar to FIG. 4 except that only thorax region 24, abdominal region 26, pelvic region 32, thigh regions 34, upper arm regions 46, and forearm regions 48 are selected in Column F with an "x" for the selected garment configuration. In this configuration, LW=25 lbs, Mcv=0.80, and GW=31.43. This mass distribution model places about 7.0 lbs in part 71, about 4.7 lbs in part 73, about 4.2 lbs in part 76, and about 6.4 lbs split between parts 771 and 772. For example, about 3.2 lbs may be placed in each of parts 771 and 772. Additionally, in this configuration the mass distribution model places about 1.7 lbs in parts 811 and 812. For example, about 0.85 lbs may be placed in each of parts 811 and 812. Also, in this configuration the mass distribution model places about 1.0 lbs in parts 821 and 822. For example, about 0.5 lbs may be placed in each of parts 821 and 822.

In one embodiment, in garment 521 about 25% to about 28% of the total weight such as total weight 61 is distributed about thorax region 24, about 16% to about 20% of the total weight is distributed about abdominal region 26, about 15% to about 19% of the total weight is distributed about pelvic region 32, about 23% to about 27% of the total weight is distributed about thigh regions 34, about 5% to about 9% of the total weight is distributed about upper arm regions 46, and about 2% to about 6% of the total weight is distributed about forearm regions 48.

A plurality of weights is distributed about garment 521 in proportion to a body mass distribution of wearer 20 and in accordance with those portions selected to receive weight. By way of example and with reference to FIG. 25, the plurality of weights may be equally or symmetrically distributed about garment 521 in accordance with a calculated weight distribution, such as weight distribution 63. In this embodiment, the plurality of weights includes a portion 502 of about 7.0 lbs distributed within part 71, a portion 503 of about 4.7 lbs distributed within part 73, a portion 504 of about 4.2 lbs distributed within part 76, a portion 506 of about 6.4 lbs distributed within parts 771 and 772, a portion 507 of about 1.7 lbs distributed within parts 811 and 812, and a portion 508 of about 1.0 lbs distributed within parts 821 and 822.

Example 8

Figure 27:
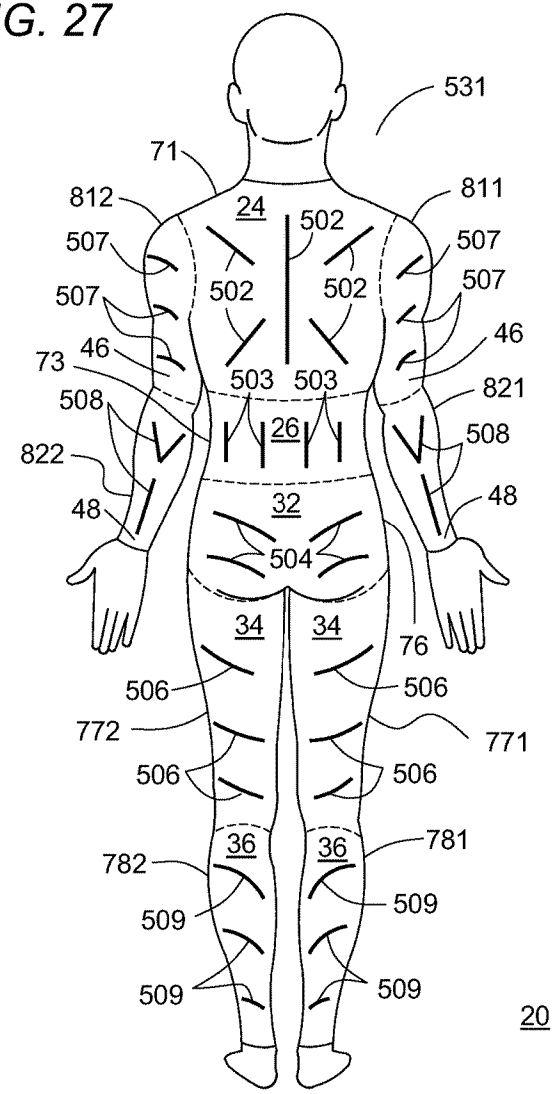
FIG. 27 illustrates a rear view of the eighth embodiment.
Figure 26:
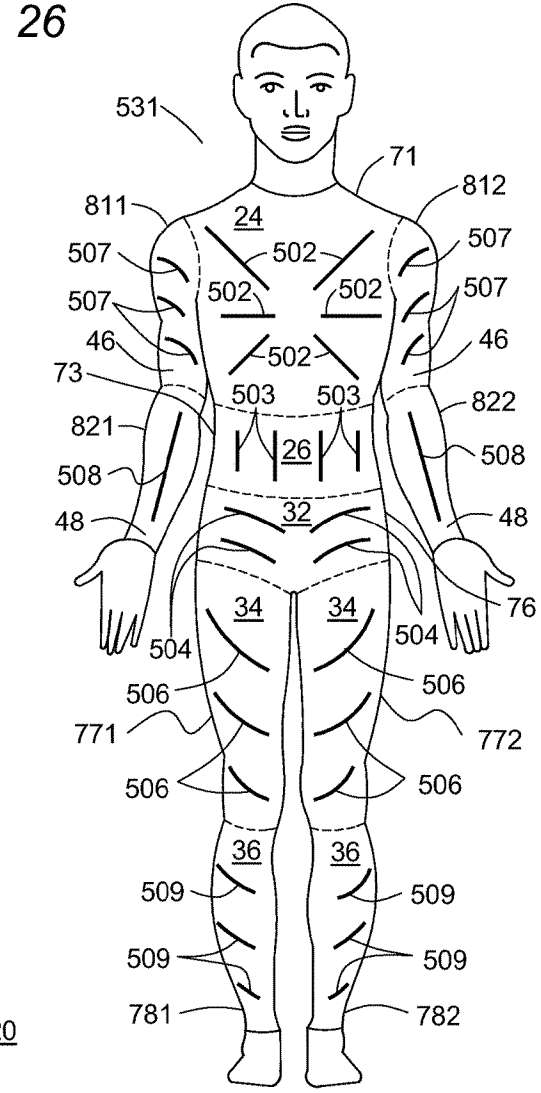
FIG. 26 illustrates a front view of weighted garment in accordance with an eighth embodiment of the present invention worn by an intended wearer.

FIGS. 26 and 27 are front and back (respectively) plan views of a weighted exercise garment 531 in accordance with an eighth embodiment worn by intended wearer 20 or another wearer. In this embodiment, weighted garment 531 may be a partial suit that covers selected regions or body portions of intended wearer 20 are covered, or weighted garment 531 may be a full-body suit that has only selected parts that are weighted. In FIGS. 26 and 27, only a partial suit is shown for ease of understanding. In this embodiment, weighted garment 521 includes at least parts 71, 73, 76, 771, 772, 781, 782, 811, 812, 821, and 822, which are also weighted.

For this example, a weight amount of 30 lbs (13.6 kg) may be selected with reference to FIG. 28, which is a table that corresponds to a mass or weight distribution model, such as weight distribution 61, for configuring this embodiment. FIG. 28 is similar to FIG. 4 except that only thorax region 24, abdominal region 26, pelvic region 32, thigh regions 34, calf regions 36, upper arm regions 46, and forearm regions 48 are selected in Column F with an "x" for the selected garment configuration. In this configuration, LW=30 lbs, Mcv=0.88, and GW=34.05. This mass distribution model places about 7.6 lbs in part 71, about 5.0 lbs in part 73, about 4.6 lbs in part 76, and about 6.9 lbs split between parts 771 and 772. For example, about 3.45 lbs may be placed in each of parts 771 and 772. Also, in this configuration the mass distribution model places about 2.9 lbs in parts 781 and 782. For example, about 1.45 lbs may be placed in each of parts 781 and 782. Additionally, in this configuration the mass distribution model places about 1.9 lbs in parts 811 and 812. For example, about 0.95 lbs may be placed in each of parts 811 and 812. Also, in this configuration the mass distribution model places about 1.1 lbs in parts 821 and 822. For example, about 0.55 lbs may be placed in each of parts 821 and 822.

In one embodiment, in garment 531 about 24% to about 26% of the total weight, such as total weight 61, is distributed about thorax region 24, about 16% to about 18% of the total weight is distributed about abdominal region 26, about 14% to about 16% of the total weight is distributed about pelvic region 32, about 21% to about 24% of the total weight is distributed about thigh regions 34, about 9% to about 11% of the total weight is distributed about calf regions 36, about 5% to about 8% of the total weight is distributed about upper arm regions 46, and about 3% to about 5% of the total weight is distributed about forearm regions 48.

A plurality of weights is distributed about garment 531 in proportion to a body mass distribution of wearer 20 and in accordance with those portions selected to receive weight. By way of example and with reference to FIG. 28, the plurality of weights may be equally or symmetrically distributed about garment 531 in accordance with a calculated weight distribution such as weight distribution 63. In this embodiment, the plurality of weights includes a portion 502 of about 7.6 lbs distributed within part 71, a portion 503 of about 5.0 lbs distributed within part 73, a portion 504 of about 4.6 lbs distributed within part 76, a portion 506 of about 6.9 lbs distributed within parts 771 and 772, a portion 507 of about 1.9 lbs distributed within parts 811 and 812, a portion 508 of about 1.1 lbs distributed within parts 821 and 822, and a portion 509 of about 2.9 lbs distributed within parts 781 and 782.

Example 9

Figure 30:
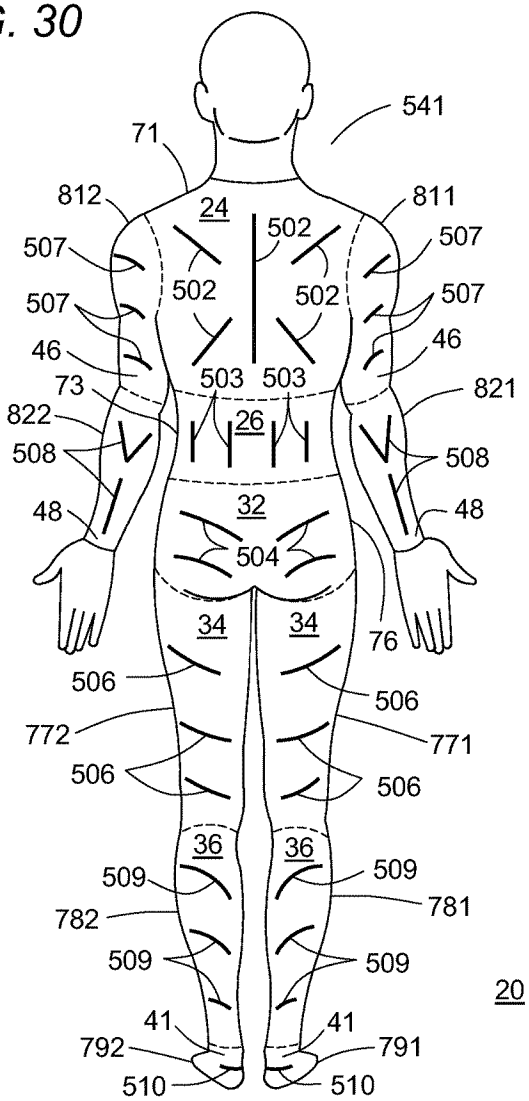
FIG. 30 illustrates a rear view of the ninth embodiment.
Figure 29:
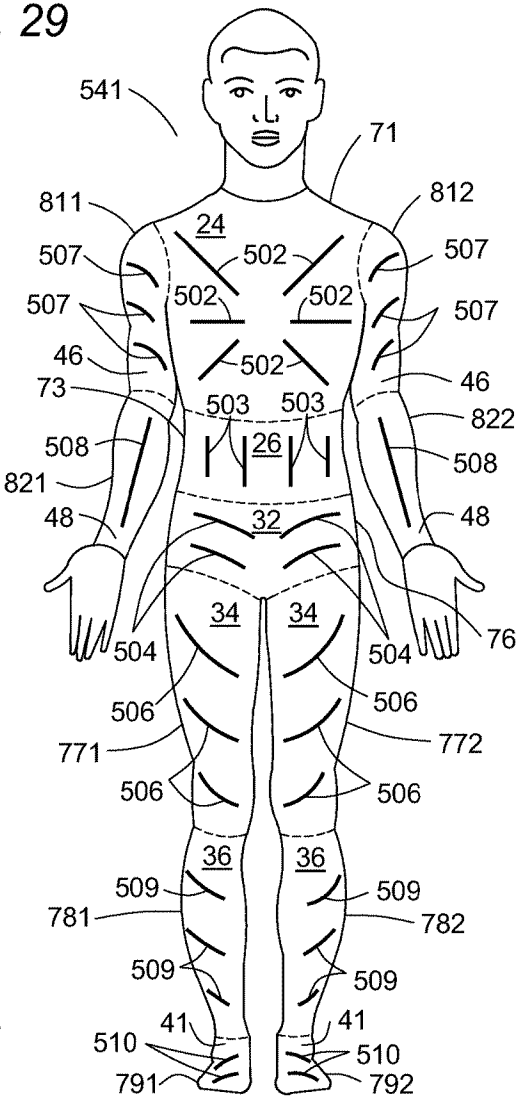
FIG. 29 illustrates a front view of weighted garment in accordance with a ninth embodiment of the present invention worn by an intended wearer.

FIGS. 29 and 30 are front and back (respectively) plan views of a weighted exercise garment 541 in accordance with a ninth embodiment worn by intended wearer 20 or another wearer. In this embodiment, weighted garment 541 may be a partial suit that covers selected regions or body portions of intended wearer 20 are covered, or weighted garment 541 may be a full-body suit that has only selected parts that are weighted. In FIGS. 29 and 30, only a partial suit is shown for ease of understanding. In this embodiment, weighted garment 541 includes at least parts 71, 73, 76, 771, 772, 781, 782, 791, 792, 811, 812, 821, and 822, which are also weighted.

For this example, a weight amount of 35 lbs (15.9 kg) may be selected with reference to FIG. 31, which is a table that corresponds to a mass or weight distribution model, such as weight distribution 61, for configuring this embodiment. FIG. 31 is similar to FIG. 4 except that only thorax region 24, abdominal region 26, pelvic region 32, thigh regions 34, calf regions 36, foot regions 41, upper arm regions 46, and forearm regions 48 are selected in Column F with an "x" for the selected garment configuration. In this configuration, LW=35 lbs, Mcv=0.91, and GW=38.55. This mass distribution model places about 8.6 lbs in part 71, about 5.7 lbs in part 73, about 5.2 lbs in part 76, and about 7.8 lbs split between parts 771 and 772. For example, about 3.9 lbs may be placed in each of parts 771 and 772. Also, in this configuration the mass distribution model places about 3.3 lbs in parts 781 and 782. For example, about 1.65 lbs may be placed in each of parts 781 and 782. Additionally, in this configuration the mass distribution model places about 2.1 lbs in parts 811 and 812. For example, about 1.05 lbs may be placed in each of parts 811 and 812. In addition, in this configuration the mass distribution model places about 1.3 lbs in parts 821 and 822. For example, about 0.65 lbs may be placed in each of parts 821 and 822. Further, in this configuration the mass distribution model places about 1.0 lbs in parts 791 and 792. For example, about 0.5 lbs may be placed in each of parts 791 and 792.

In one embodiment, in garment 541 about 23% to about 25% of the total weight, such as total weight 61, is distributed about thorax region 24, about 15% to about 17% of the total weight is distributed about abdominal region 26, about 14% to about 16% of the total weight is distributed about pelvic region 26, about 21% to about 23% of the total weight is distributed about thigh regions 32, about 5% to about 8% of the total weight is distributed about upper arm regions 46, about 3% to about 5% of the total weight is distributed about forearm regions 48, about 9% to about 11% of the total weight is distributed about the calf regions 36, and about 2% to about 4% of the total weight is distributed about foot regions 41.

A plurality of weights is distributed about garment 541 in proportion to a body mass distribution of wearer 20 and in accordance with those portions selected to receive weight. By way of example and with reference to FIG. 31, the plurality of weights may be equally or symmetrically distributed about garment 541 in accordance with a calculated weight distribution such as weight distribution 63. In this embodiment, the plurality of weights includes a portion 502 of about 8.6 lbs distributed within part 71, a portion 503 of about 5.7 lbs distributed within part 73, a portion 504 of about 5.2 lbs distributed within part 76, a portion 506 of about 7.8 lbs distributed within parts 771 and 772, a portion 507 of about 2.1 lbs distributed within parts 811 and 812, a portion 508 of about 1.3 lbs distributed within parts 821 and 822, a portion 509 of about 3.3 lbs distributed within parts 781 and 782, and a portion 510 of about 1.0 lbs distributed with parts 792 and 792. It is understood that parts 791 and 792 may comprise shoes that receive the designated weight, or the shoes themselves may comprise the designated weight.

Example 10

Figure 33:
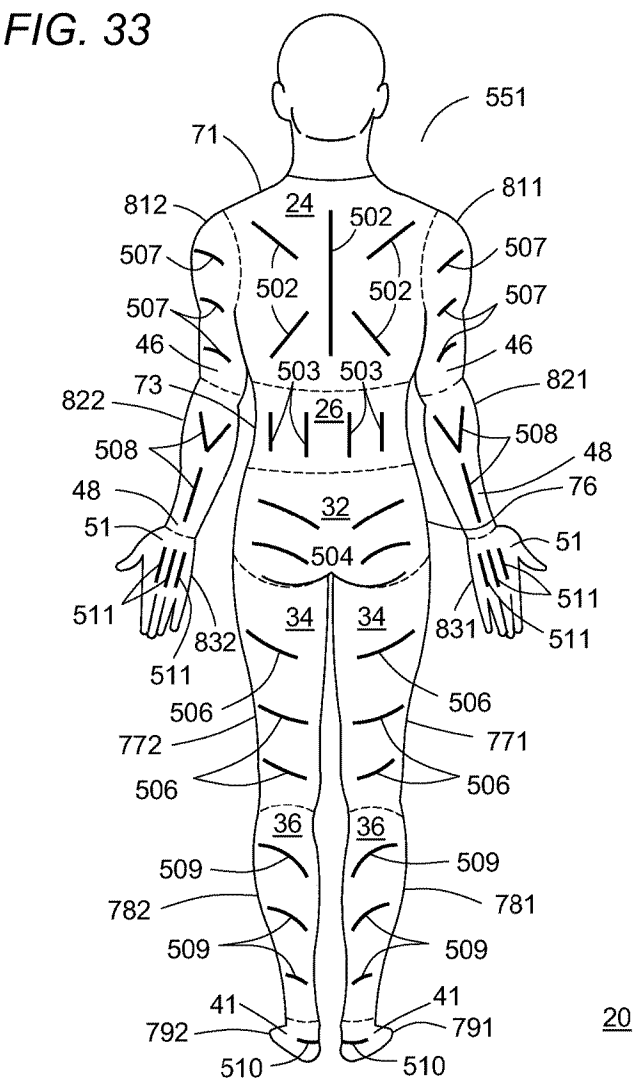
FIG. 33 illustrates a rear view of the tenth embodiment.
Figure 32:
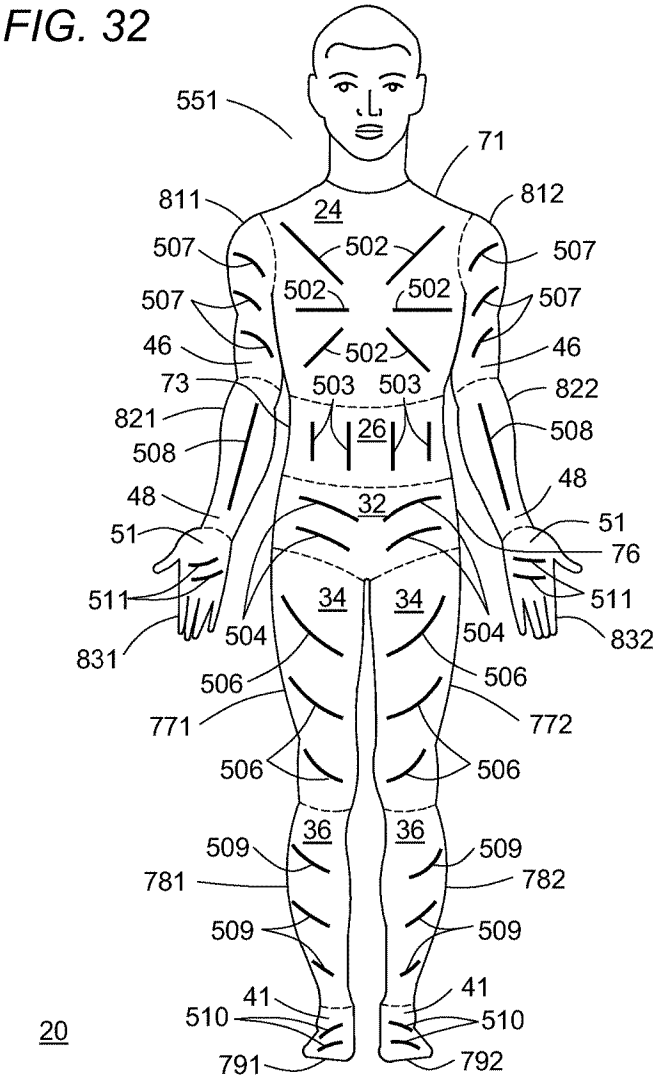
FIG. 32 illustrates a front view of weighted garment in accordance with a tenth embodiment of the present invention worn by an intended wearer.

FIGS. 32 and 33 are front and back (respectively) plan views of a weighted exercise garment 551 in accordance with a ninth embodiment worn by intended wearer 20 or another wearer. In this embodiment, weighted garment 551 may be a partial suit that covers selected regions or body portions of intended wearer 20 are covered, or weighted garment 551 may be a full-body suit that has only selected parts that are weighted. In FIGS. 32 and 33, only a partial suit is shown for ease of understanding. In this embodiment, weighted garment 551 includes at least parts 71, 73, 76, 771, 772, 781, 782, 791, 792, 811, 812, 821, 822, 831, and 832, which are also weighted.

For this example, a weight amount of 35 lbs (15.9 kg) may be selected with reference to FIG. 34, which is a table that corresponds to a mass or weight distribution model such as weight distribution 61 for configuring this embodiment. FIG. 34 is similar to FIG. 4 except that only thorax region 24, abdominal region 26, pelvic region 32, thigh regions 34, calf regions 36, foot regions 41, upper arm regions 46, forearm regions 48, and hand regions 51 are selected in Column F with an "x" for the selected garment configuration. In this configuration, LW=35 lbs, Mcv=0.92, and GW=38.04. This mass distribution model places about 8.4 lbs in part 71, about 5.6 lbs in part 73, about 5.1 lbs in part 76, and about 7.7 lbs split between parts 771 and 772. For example, about 3.85 lbs may be placed in each of parts 771 and 772. Also, in this configuration the mass distribution model places about 3.3 lbs in parts 781 and 782. For example, about 1.65 lbs may be placed in each of parts 781 and 782. Additionally, in this configuration the mass distribution model places about 2.1 lbs in parts 811 and 812. For example, about 1.05 lbs may be placed in each of parts 811 and 812. In addition, in this configuration the mass distribution model places about 1.3 lbs in parts 821 and 822. For example, about 0.65 lbs may be placed in each of parts 821 and 822. Further, in this configuration the mass distribution model places about 1.0 lbs in parts 791 and 792. For example, about 0.50 lbs may be placed in each of parts 791 and 792. Further, in this configuration the distribution model places about 0.5 lbs in parts 831 and 832. For example, about 0.25 lbs may be placed in each of parts 831 and 832.

In one embodiment, in garment 551 about 23% to about 25% of the total weight, such as total weight 61, is distributed about thorax region 24, about 15% to about 17% of the total weight is distributed about abdominal region 26, about 14% to about 16% of the total weight is distributed about pelvic region 32, about 21% to about 23% of the total weight is distributed about thigh regions 34, about 5% to about 7% of the total weight is distributed about upper arm regions 46, about 3% to about 4% of the total weight is distributed about forearm regions 48, about 8% to about 10% of the total weight is distributed about calf regions 36, about 2% to about 4% of the total weight is distributed about foot regions 41, and about 1% to about 2% of the total weight is distributed about hand regions 51.

A plurality of weights is distributed about garment 551 in proportion to a body mass distribution of wearer 20 and in accordance with those portions selected to receive weight. By way of example and with reference to FIG. 34, the plurality of weights may be equally or symmetrically distributed about garment 551 in accordance with a calculated weight distribution, such as weight distribution 63. In this embodiment, the plurality of weights includes a portion 502 of about 8.4 lbs distributed within part 71, a portion 503 of about 5.6 lbs distributed within part 73, a portion 504 of about 5.1 lbs distributed within part 76, a portion 506 of about 7.7 lbs distributed within parts 771 and 772, a portion 507 of about 2.1 lbs distributed within parts 811 and 812, a portion 508 of about 1.3 lbs distributed within parts 821 and 822, a portion 509 of about 3.3 lbs distributed within parts 781 and 782, and a portion 510 of about 1.0 lbs distributed within parts 792 and 792. It is understood that parts 791 and 792 may comprise shoes that receive the designated weight, or the shoes themselves may comprise the designated weight. In addition, the plurality of weights includes a portion 511 of about 0.5 lbs distributed within parts 831 and 832.

Other embodiments are apparent from the present description. For example, a neck region and a head region may be added to any of Examples 3-10 using the mass or weight distribution models described herein. Additionally, any combination of parts or regions described with Example 2 that are missing from any of Examples 3-10 may be added as desired using the mass or weight distribution models described herein. Further, any region described herein may be used by itself using the mass distribution models described herein.

From all of the foregoing, one skilled in the art can determine that according to one embodiment, a method for forming a weighted garment (for example, element 68, 70, 401, 451, 501, 521, 531, 541, 551, 701, 707) comprises the steps of providing a body mass distribution (for example, element 11) of an intended wearer (for example, element 20). The method includes selecting a weight amount (for example, element 61) and selecting portions of a body to be weighted (for example, element 62). The method includes determining a weight distribution (for example, element 63) using the body mass distribution of the intended wearer, the weight amount, and the selected portions of the body to be weighted.

Those skilled in the art will also appreciate that according to another embodiment, a method of forming a weighted garment comprises the steps of providing a predetermined weight distribution (for example, element 63) that is a function of body mass distribution (for example, element 11) of an intended wearer, a selected weight amount (for example, element 61) and selected portions of a body to be weighted (for example, element 62). The method includes providing a garment and placing a plurality of weights in spaced relationship with the garment in accordance with the predetermined weight distribution.

Those skilled in the art will also appreciate that according to yet another embodiment, a weighted garment (for example, element 68, 70, 401, 451, 501, 521, 531, 541, 551, 701, 707) comprises a material configured to substantially conform to at least a portion of a body of an intended wearer (for example, element 20) when placed thereon, and a plurality of weights that sum to a total weight (for example, element 61) where the total weight is distributed about the material in accordance with a predetermined body mass distribution (for example, element 11) of the intended wearer.

Those skilled in the art will also appreciate that according to a further embodiment, a garment (for example, element 70) comprises a first portion (for example, element 71) that is configured for covering a thorax region (for example, element 24) of a wearer (for example, element 20) when placed thereon. The garment comprises a second portion (for example, element 73) for covering an abdominal region (for example, element 26) of the wearer, a third portion (for example, element 76) for covering a pelvic region (for example, element 32) of the wearer, a fourth portion (for example, element 771) for covering a first thigh region (for example, element 34) of the wearer, and a fifth portion (for example, element 772) for covering a second thigh region (for example, element 34) of the wearer. The garment comprises a sixth portion (for example, element 781) for covering a first calf region (for example, element 36) of the wearer, a seventh portion (for example, element 782) for covering a second calf region (for example, element 36) of the wearer, an eighth portion (for example, element 791) for covering a first foot region (for example, element 41) of the wearer, and a ninth portion (for example, element 792) for covering a second foot region (for example, element 41) of the wearer. The garment comprises a tenth portion (for example, element 811) for covering a first upper arm region (for example, element 46) of the wearer, an eleventh portion (for example, element 812) for covering a second upper arm region (for example, element 46) of the wearer, a twelfth portion (for example, element 821) for covering a first forearm region (for example, element 48) of the wearer, and a thirteenth portion (for example, element 822) for covering a second forearm region (for example, element 48) of the wearer. The garment comprises a fourteenth portion (for example, element 831) for covering a first hand region (for example, element 51) of the wearer, a fifteenth portion (for example, element 832) for covering a second hand region (for example, element 51) of the wearer, a sixteenth portion (for example, element 77) for covering a least a part of the neck region (for example, element 53) of the wearer, and a seventeenth portion (for example, element 78) for covering a least a part of the head region (for example, element 56) of the wearer. The garment includes a plurality of weights (for example, elements 910, 911, 912, 913, 914, 916, 917, 918, 919, 921, 922) distributed about the garment in proportion to a body mass distribution (for example, element 11) of the wearer.

In addition, those skilled in the art will appreciate that in one embodiment, a garment includes about 22.2% of the total weight distributed about the thorax region (for example, element 24), about 14.8% total weight is distributed about the abdominal region (for example, element 26), about 13.5% of the total weight is distributed about pelvic region (for example, element 32), about 20.3% of the total weight is distributed about thigh regions (for example, element 34), about 5.5% of the total weight is distributed about upper arm regions (for example, element 46), about 3.3% of the total weight is distributed about forearm regions (for example, element 48), about 8.6% of the total weight is distributed about calf regions (for example, element 36), about 2.7% of the total weight is distributed about foot regions (for example, element 41, about 1.2% to about of the total weight is distributed about hand regions (for example, element 51), about 2.1% of the total weight is distributed about the neck region (for example, element 53), and about 5.9% of the total weight is distributed about the head region (for example, element 56).

In summary, this description has set forth a weighted garment that comprises a material that is configured to substantially conform to at least a portion of the body of an intended wearer when it is placed on wearer. The garment also includes a plurality of weights that sum to a total weight where the total weight is distributed about the material in accordance with a predetermined body mass distribution of the intended wearer. The description also pertains to a method of forming a weighted garment that comprises the steps of providing a predetermined weight distribution that is a function of body mass distribution of an intended wearer, a selected weight amount, and selected portions of a body to be weighted. The method also includes providing a garment and placing a plurality of weights in spaced relationship with the garment in accordance with the predetermined weight distribution. By distributing the predetermined weight about the garment in this manner, the intended wearer receives more optimal results in muscle system performance, strength, and stamina enhancement.

Although the invention has been described and illustrated with reference to specific embodiments thereof, it is not intended that the invention be limited to these illustrative embodiments. Those skilled in the art will recognize that modifications and variations can be made without departing from the spirit of the invention. Therefore, it is intended that this invention encompass all such variations and modifications that fall within the scope of the appended claims.

I claim:

1. A weighted garment comprising:

a body suit configured to substantially conform to at least a portion of a body of an intended wearer when placed on the intended wearer, where the body suit has a plurality of parts; and a plurality of weights that sum to a total weight, where portions of the plurality of weights are engaged with and located within each part of the body suit, and where the portions of the plurality of weights engaged with each part are apportioned from the total weight based on a predetermined body mass distribution of the intended wearer.

2. The weighted garment of claim 1 where the plurality of parts comprises:

a first part configured to cover a thorax region and an abdominal region where about 19.5% to about 23% of the total weight is located within the thorax region and about 13% to about 16% of the total weight is located within the abdominal region;

a second part configured to cover a pelvic region, thigh regions, calf regions, and foot regions, where about 13% to about 16% of the total weight is located within the pelvic region, about 19% to about 22% of the total weight is located within the thigh regions, about 8% to about 11% of the total weight is located within the calf regions, and about 1.5% to about 3.5% of the total weight is located within the foot regions;

a third part configured to cover upper arm regions, forearm regions, and hand regions, where about 4% to about 7% of the total weight is located within the upper arm regions, about 1.75% to about 5% of the total weight is located within the forearm regions, and about 0.75% to about 3% of the total weight is located within the hand regions; and a fourth part configured to cover a neck region and at least part of a head region, where about 0.75% to about 3% of the total weight is located within the neck region and about 3.75% to about 6.5% of the total weight is located within the at least part of the head region.

3. The weighted garment of claim 1 where the plurality of weights is substantially equally distributed within each part of the body suit in accordance with centers of mass of parts of the intended wearer's body intended to be covered by corresponding body suit parts.

4. The weighted garment of claim 1 where the body suit includes a first part configured to cover a central body region of the intended wearer and where the first part is further configured to cover a thorax region and an abdominal region.

5. The weighted garment of claim 4 where about 58% to about 62% of the total weight is located within the thorax region and about 38% to about 42% of the total weight is located within the abdominal region.

6. The weighted garment of claim 4 where the body suit includes a second part configured to cover lower extremities of the intended wearer and where the second part is further configured to cover a pelvic region and thigh regions.

7. The weighted garment of claim 6 where about 30% to about 34% of the total weight is located within the thorax region, about 19% to about 23% of the total weight is located within the abdominal region, about 17% to about 21% of the total weight is located about the pelvic region, and about 27% to about 31% of the total weight is located within the thigh regions.

8. The weighted garment of claim 7 where about 27% to about 31% of the total weight distributed within the thigh regions is equally distributed.

9. The weighted garment of claim 6 where the second part is further configured to cover calf regions.

10. The weighted garment of claim 9 where about 25% to about 29% of the total weight is located within the thorax region, about 16% to about 20% of the total weight is located within the abdominal region, about 15% to about 19% of the total weight is located within the pelvic region, about 23% to about 27% of the total weight is located within the thigh regions, and about 8% to about 12% of the total weight is located within the calf regions.

11. The weighted garment of claim 9 where the second part is further configured to cover foot regions.

12. The weighted garment of claim 11 where about 24% to about 28% of the total weight is located within the thorax region, about 15% to about 19% of the total weight is located within the abdominal region, about 14% to about 18% of the total weight is located within the pelvic region, about 22% to about 26% of the total weight is located within the thigh regions, about 7% to about 11% of the total weight is located within the calf regions, and about 2% to about 4% of the total weight is located within the foot regions.

13. The weighted garment of claim 6 where the body suit includes a third part configured to cover upper extremities of the intended wearer and where the third part is configured to cover upper arm regions.

14. The weighted garment of claim 13 where about 27% to about 29% of the total weight is located within the thorax region, about 17% to about 21% of the total weight is located within the abdominal region, about 16% to about 20% of the total weight is located within the pelvic region, about 25% to about 29% of the total weight is located within the thigh regions, and about 6% to about 9% of the total weight is located within the upper arm regions.

15. The weighted garment of claim 13 where the third part is further configured to cover forearm regions.

16. The weighted garment of claim 15 where about 25% to about 28% of the total weight is located within the thorax region, about 16% to about 20% of the total weight is located within the abdominal region, about 15% to about 19% of the total weight is located within the pelvic region, about 23% to about 27% of the total weight is located within the thigh regions, about 5% to about 9% of the total weight is located within the upper arm regions, and about 2% to about 6% of the total weight is located within the forearm regions.

17. The weighted garment of 15 where the second part is further configured to cover calf regions.

18. The weighted garment of claim 17 where about 24% to about 26% of the total weight is located within the thorax region, about 16% to about 18% of the total weight is located within the abdominal region, about 14% to about 16% of the total weight is located within the pelvic region, about 21% to about 24% of the total weight is located within the thigh regions, about 5% to about 8% of the total weight is located within the upper arm regions, about 3% to about 5% of the total weight is located within the forearm regions, and about 9% to about 11% of the total weight is located within the calf regions.

19. The weighted garment of claim 17 where the second part is further configured to cover foot regions.

20. The weighted garment of claim 19 where about 23% to about 25% of the total weight is located within the thorax region, about 15% to about 17% of the total weight is located within the abdominal region, about 14% to about 16% of the total weight is located within the pelvic region, about 21% to about 23% of the total weight is located within the thigh regions, about 5% to about 8% of the total weight is located within the upper arm regions, about 3% to about 5% of the total weight is located within the forearm regions, about 9% to about 11% of the total weight is located within the calf regions, and about 2% to about 4% of the total weight is located within the foot regions.

21. The weighted garment of claim 19 where the third part is further configured to cover at least portions of hand regions.

22. The weighted garment of claim 21 where about 23% to about 25% of the total weight is located within the thorax region, about 15% to about 17% of the total weight is located within the abdominal region, about 14% to about 16% of the total weight is located within the pelvic region, about 21% to about 23% of the total weight is located within the thigh regions, about 5% to about 7% of the total weight is located within the upper arm regions, about 3% to about 4% of the total weight is located within the forearm regions, about 8% to about 10% of the total weight is located within the calf regions, about 2% to about 4% of the total weight is located within the foot regions, and about 1% to about 2% of the total weight is located within the hand regions.

23. The weighted garment of claim 21 where the body suit includes a fourth part configured to cover a neck region.

24. The weighted garment of claim 23 where the fourth part is configured to cover the neck region and at least part of a head region.

25. The weighted garment of claim 24 where about 19.5% to about 23% of the total weight is located within the thorax region, about 13% to about 16% of the total weight is located within the abdominal region, about 13% to about 16% of the total weight is located within the pelvic region, about 19% to about 22% of the total weight is located within the thigh regions, about 8% to about 11% of the total weight is located within the calf regions, about 1.5% to about 3.5% of the total weight is located within the foot regions, about 4% to about 7% of the total weight is located within the upper arm regions, about 1.75% to about 5% of the total weight is located within the forearm regions, about 0.75% to about 3% of the total weight is located within the hand regions, about 0.75% to about 3% of the total weight is located within the neck region, and about 3.75% to about 6.5% of the total weight is located within the at least part of the head region.

26. A weighted garment comprising:

a body suit configured to substantially conform to at least a portion of a body of an intended wearer when placed on the intended wearer, where the body suit has a plurality of parts; and a plurality of weights that sum to a total weight where:

portions of the plurality of weights are unevenly allocated and joined to each part of the body suit in accordance with a predetermined body mass distribution of the intended wearer.

27. The weighted garment of claim of claim 26, where the body suit comprises:

a first part configured to cover a thorax region and an abdominal region;

a second part configured to cover a pelvic region, thigh regions, calf regions, and foot regions;

a third part configured to cover upper arm regions, forearm regions, and hand regions; and a fourth part configured to cover a neck region and at least part of a head region.

28. The weighted garment of claim 27 where about 19.5% to about 23% of the total weight is located within the thorax region, about 13% to about 16% of the total weight is located within the abdominal region, about 13% to about 16% of the total weight is located within the pelvic region, about 19% to about 22% of the total weight is located within the thigh regions, about 8% to about 11% of the total weight is located within the calf regions, about 1.5% to about 3.5% of the total weight is located within the foot regions, about 4% to about 7% of the total weight is located within the upper arm regions, about 1.75% to 5% of the total weight is located within the forearm regions, about 0.75% to about 3% of the total weight is located within the hand regions, about 0.75% to about 3% of the total weight is located within the neck region, and about 3.75% to about 6.5% of the total weight is located within the at least part of the head region.

* * * * *